US012768254B2

(12) United States Patent
Farmer et al.

(10) Patent No.: US 12,768,254 B2
(45) Date of Patent: Oct. 20, 2026

(54) METHOD FOR AUTOMATING THE APPLICABILITY OF JOB-RELATED LESSONS LEARNED

(71) Applicant: Halliburton Energy Services, Inc., Houston, TX (US)

(72) Inventors: Marjorie Farmer, Houston, TX (US); Paul Michael Osborne, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1132 days.

(21) Appl. No.: 17/743,943

(22) Filed: May 13, 2022

(65) Prior Publication Data

US 2023/0366303 A1 Nov. 16, 2023

(51) Int. Cl.
*E21B 43/26* (2006.01)
*E21B 47/12* (2012.01)

(52) U.S. Cl.
CPC ..... *E21B 43/26* (2013.01); *E21B 47/12* (2013.01); *E21B 2200/20* (2020.05); *E21B 2200/22* (2020.05)

(58) Field of Classification Search
CPC ..... G06F 30/25; G06F 30/27; G06F 30/28
See application file for complete search history.

(56) References Cited

U.S. PATENT DOCUMENTS

2009/0188718 A1* 7/2009 Kaageson-Loe ..... E21B 21/003 175/57
2013/0181155 A1* 7/2013 Robison ..... F16K 25/005 251/324
2017/0328178 A1* 11/2017 Lucas ..... E21B 44/00
2019/0032476 A1* 1/2019 Yerubandi ..... E21B 33/13
2020/0149354 A1 5/2020 Singh et al.
2020/0332627 A1* 10/2020 Tang ..... E21B 44/00
2021/0255913 A1* 8/2021 Singh ..... G06F 11/076
(Continued)

FOREIGN PATENT DOCUMENTS

WO WO-2019051435 A1 * 3/2019 ..... E21B 44/00
WO 2019178460 A1 9/2019

OTHER PUBLICATIONS

Ch. 1: Caenn, Ryen & Darley, H.C.H. & Gray, George. (2011). Introduction to Drilling Fluids. 10.1016/B978-0-12-383858-2.00001-9. (Year: 2017).*

(Continued)

*Primary Examiner* — Ryan F Pitaro
*Assistant Examiner* — Jay Michael White
(74) *Attorney, Agent, or Firm* — Conley Rose, P.C.; Rodney B. Carroll

(57) ABSTRACT

A method of classifying job observations with metadata tags for retrieval from a database during the designing of a wellbore treatment. A machine learning process applies a set of metadata tags to the observation description and observation object based on a training set of job observations. The machine learning process validates the metadata tags based on a classification grade determined by the ranking of the job observation within a search result. A managing application can modify a job design comprising an inventory of wellbore treatment materials and pumping equipment based on job observations with metadata tags that match the metadata tags of the job design.

20 Claims, 8 Drawing Sheets

(56) References Cited

U.S. PATENT DOCUMENTS

2022/0025753 A1* 1/2022 Heidari ..... G06N 20/20
2023/0022567 A1* 1/2023 Cheng ..... G06Q 50/08

OTHER PUBLICATIONS

Lecoutier, Jaqueline and Cartalos, U. "Cementing Technology and Procedures: Introduction". Editions Technip. 1993 ISBN10 27110806495 (Year: 1993).*
Lecoutier, Jaqueline and Cartalos, U. "Cementing Technology and Procedures: Chapter 1". Editions Technip. 1993 ISBN10 27110806495 (Year: 1993).*
Lecoutier, Jaqueline and Cartalos, U. "Cementing Technology and Procedures: Chapter 2". Editions Technip. 1993 ISBN10 27110806495 (Year: 1993).*
Chang, Yong & Hammond, Paul & Pop, Julian. (2005). When Should We Worry About Supercharging in Formation Pressure While Drilling Measurements?. 10.2523/92380-MS. (Year: 2005).*
Chevron, "Lost Circulation Guide". Drilling Specialties Company, A Division of Chevron (2014) (Year: 2014).*
Automation Logic LLC, "Concrete Rhino Automated Batching Systems" https://www.automation-logic.com (Year: 2020).*
Gu, Ming & Gokaraju, Deepak & Chen, Dingding & Quirein, John. (2016). Shale Fracturing Characterization and Optimization by Using Anisotropic Acoustic Interpretation, 3D Fracture Modeling, and Supervised Machine Learning. 573-587. (Year: 2016).*
Heathman, James & Beck, Frederick. (2006). Finite Element Analysis Couples Casing and Cement Designs for HTHP Wells in East Texas. 10.2118/98869-MS. (Year: 2006).*
Hommel, Johannes & Coltman, Edward & Class, Holger. (2018). PorosityaPermeability Relations for Evolving Pore Space: A Review with a Focus on (Bio-)geochemically Altered Porous Media. Transport in Porous Media. 124. 10.1007/s11242-018-1086-2. (Year: 2018).*
API Standard 65—Part 2. "Isolating Potential Flow Zones During Well Construction". 2010 (Year: 2010).*
Jebutu, S. O., Silbernagel, M., Dugas, B. C., Lamborn, R., and O. Akimov. "Enhanced Formation Integrity Test FIT Interpretation and Decision Making Through Real-Time Downhole Pressure Measurements." Paper presented at the SPE/IADC Drilling Conference and Exhibition, Mar. 2017 (Year: 2017).*
Li, Yumei. "Simulation of the interactions between multiple hydraulic fractures and natural fracture network based on Discrete Element Method numerical modeling". Energy Science & Engineering. May 3, 2020 https://doi.org/10.1002/ese3.712 (Year: 2020).*
Majidi, Reza & Miska, Stefan & Zhang, Jianguo. (2011). Fingerprint of Mud Losses into Natural or Induced Fractures. 1. 10.2118/143854-MS. (Year: 2011).*
Haiyeng: Lv, H. & Liu, J.. (2016). High Efficiency Web Page Metadata Search Method for Large Data Applications. International Journal of Simulation: Systems, Science & Technology. (Year: 2016).*
Janda, Alvaro & Zuriguel, Iker & GarcimartÃÂ-n, Angel & Pugnaloni, Luis & Maza, Diego. (2008). Jamming and critical outlet size in the discharge of a two-dimensional silo. EPL (Europhysics Letters). (Year: 2008).*
Janda, Alvaro & Zuriguel, Iker & Maza, Diego. (2012). Flow Rate of Particles through Apertures Obtained from Self-Similar Density and Velocity Profiles. Physical Review Letters. 108. 10.1103/PhysRevLett.108.248001. (Year: 2012).*
NASA: "Improving Data Access and Data Management: Artificial Intelligence-Generated Metadata Tags at NASA". https://resources.data.gov/resources/fdspp-nasa-ai-metadata-tags/ (Year: 2019).*
Ashley, Kevin D. "Applying Textual Case-Based Reasoning and Information Extraction in Lessons Learned Systems". AAAAI Workshop Papers 2000 (Year: 2000).*
Bian, Jiang & Liu, Tie-Yan & Qin, Tao & Zha, Hongyuan. (2010). Ranking with Query-Dependent Loss for Web Search. 141-150. (Year: 2010).*
Chirumalla, Koteshwar. (2016). Organizing Lessons Learned Practice for Product-Service Innovation. Journal of Business Research. 69. 4986â4991. (Year: 2016).*
Eken, Gorkem & Bilgin, Gozde & Dikmen, Irem & Birgonul, M.. (2020). A Lessons-Learned Tool for Organizational Learning in Construction. Automation in Construction. (Year: 2020).*
Everett, John & Bobrow, Daniel. (2000). Resolving Redundancy: A Recurring Problem in a Lessons Learned System. (Year: 2000).*
Gonzalez, Luis. (2021). Investigating the Benefits of Applying Artificial Intelligence Techniques to Enhance Learning Experiences in Capstone Courses. 398-400. 10.1145/3446871.3469770. (Year: 2021).*
Hinze, Iris & Perry, Philip & Jacob, George & Wise, Wade. (2012). Implementing Knowledge Sharing Systems and Establishing a Culture to Share Lessons Learned Within a Multidisciplinary Company Enhancing Effective Knowledge Transfer. (Year: 2012).*
Jaselskis, Edward J. et al. "Communicate Lessons, Exchange Advice, Record (CLEAR) Database Development" (Year: 2021).*
Kowsari, Kamran & Jafari Meimandi, Kiana & Heidarysafa, Mojtaba & Mendu, Sanjana & Barnes, Laura & Brown, Donald. (2019). Text Classification Algorithms: A Survey. (Year: 2019).*
Mohapatra, Pritish & Rolinek, Michal & Jawahar, C. & Kolmogorov, Vladimir & Kumar, M.. (2016). Efficient Optimization for Rank-based Loss Functions. (Year: 2016).*
Najjar et al. "Learning Object Metadata: An Empirical Investigation and Lessons Learned". Katholieke Universiteit Leuven (Year: 2008).*
Al-Qubaisi, Salama Saeed. "Incidents Investigations and Learning Approach in Oil & Gas Industry." Paper presented at the Abu Dhabi International Petroleum Exhibition & Conference, Abu Dhabi, UAE, Nov. 2019. (Year: 2019).*
Lopez Quintero, Jose & GarcÃ-a, VÃ-ctor & Pelayo GarcÃ-a-Bustelo, B.. (2016). Knowledge Management Metamodel from Social Analysis of Lessons Learnt Registered in the Cloud. (Year: 2016).*
R Weber, D.W Aha, I Becerra-Fernandez. "Intelligent lessons learned systems" Expert Systems with Applications, vol. 20, Issue 1, 2001, pp. 17-34, ISSN 0957-4174 (Year: 2001).*
White, Ethan & Baldridge, Elita & Brym, Zachary & Locey, Kenneth & McGlinn, Daniel & Supp, Sarah. (2013). Nine simple ways to make it easier to (re)use your data. Ideas in Ecology and Evolution. (Year: 2013).*
Yeung, C & Wang, W.M. & Cheung, Benny C.F. & Tsui, Eric & Setchi, Rossi & W.B., Lee. (2018). Computational narrative mapping for the acquisition and representation of lessons learned knowledge. Engineering Applications of Artificial Intelligence. (Year: 2018).*
Chen et al. Semantic relation extraction from socially-generated tags: a methodology for metadata generation. In Proceedings of the 2008 International Conference on Dublin Core and Metadata Applications (DCMI '08). Dublin Core Metadata Initiative, 117-127. (Year: 2008).*
Foreign Communication from Related Application—International Search Report and Written Opinion of the International Searching Authority, International Application No. PCT/US2023/013756, dated Jun. 21, 2023, 12 pages.

* cited by examiner

METHOD FOR AUTOMATING THE APPLICABILITY OF JOB-RELATED LESSONS LEARNED

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In oil and gas wells a primary purpose of drilling a wellbore is the extraction of hydrocarbons from a hydrocarbon bearing formation. The construction of the oil & gas wells can include a series of construction stages including drilling, cementing, and completion. Each construction stage can be carried out by service personnel utilizing specialized equipment and materials while following a series of preplanned steps to complete each stage. At the completion of each stage, the service personnel may issue a stage report detailing the services provided which may include details of at least some of the steps, the operation of the equipment, the materials used, or some combination thereof.

The stage report may differ from the preplanned steps for a variety of unplanned occurrences or environmental conditions. For example, a drill bit may encounter a formation with an unexpected mineralogy resulting in an unscheduled change in fluid, e.g., drilling mud, to be compatible with the formation. In another example, a cementing operation may encounter a challenge obtaining the specified mechanical properties of the cement due to the quality of water available. The changes found in the stage report can be transferred to the planning for a neighboring well, e.g., an offset well, to be constructed soon after the completion of the first well. However, the reason for the changes and in what circumstances to apply the changes can be difficult to apply to other well construction projects that are planned by different locations.

A construction stage for an oil and gas well may be optimized by the selection of materials, chemicals, the type of pumping equipment, and the choice of downhole equipment based on changes made to construction stages on similar oil and gas wells. A method for the selection of materials, chemicals, and equipment is needed.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
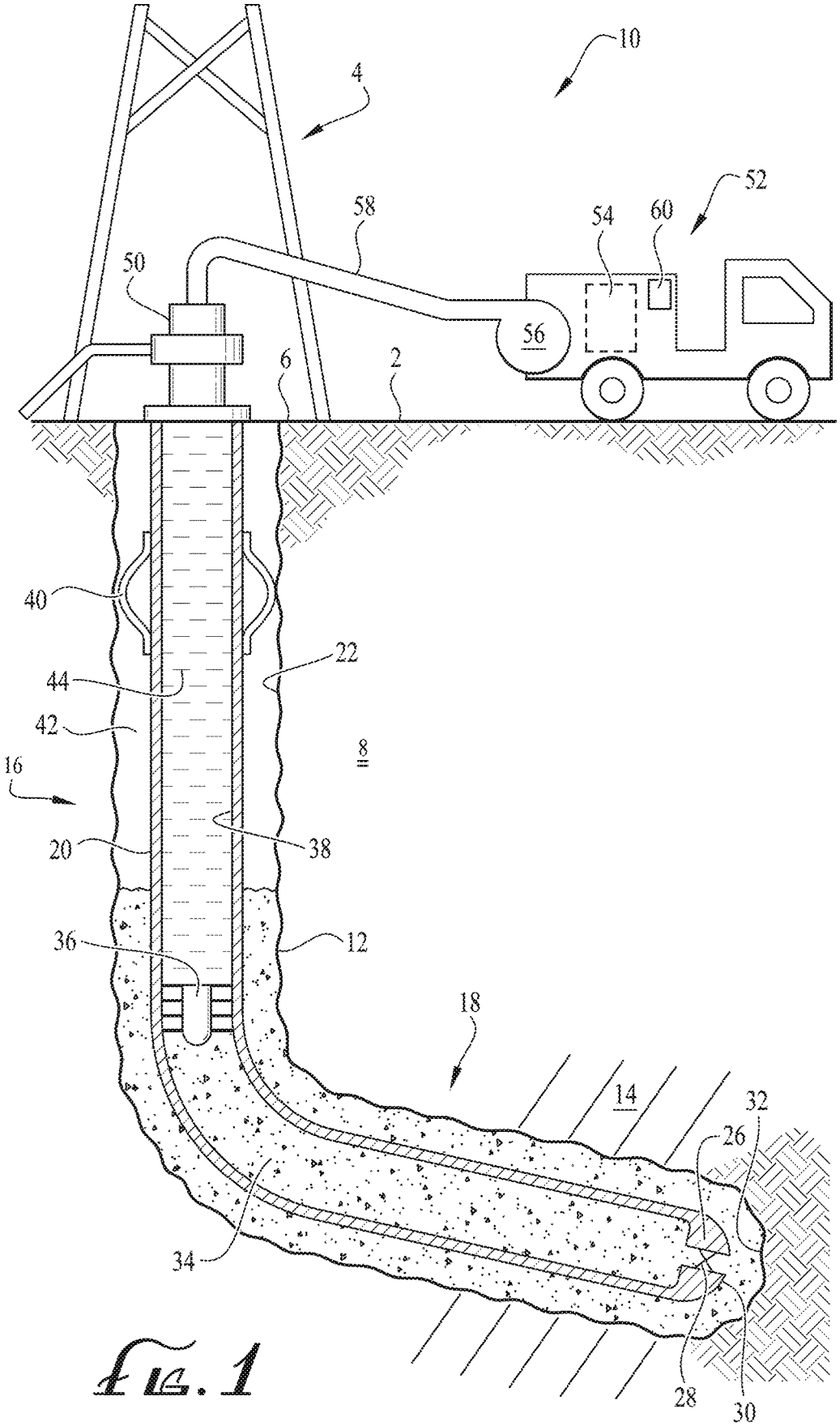
FIG. 1 is a cut-away illustration of an operating environment at a wellsite according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The construction of an oil well can begin with a drilling operation comprising a drilling rig, a drill bit, and a mud system. A suitable drilling rig can be located on a drilling pad on land or on at an offshore location above the drilling location on the seafloor. As the drill bit penetrates the earth strata, a drilling mud is pumped down a drill string to bring cuttings back to surface. The mud pumping equipment may include a mixing system for blending the dry mud with a liquid and various additives. The drilling mud can be water based or oil based with a clay material to increase the weight of the fluid. The drilling mud may also contain various other chemicals to for compatibility with the wellbore and to enhance the ability to return cuttings to surface. The weight of the drilling fluids can retain the desired hydrocarbons in the formation until the well is completed.

Typically, the next construction stage comprises a cementing operation to isolate the wellbore from formation fluids and pressure. A string of casing can be lowered into the wellbore and a cement slurry, e.g., cement composition, can be placed into the annulus formed between a string of casing (also referred to as a casing string or casing) and the wellbore. The cement typically used for cementing oil wells can be a Portland cement tailored for compatibility with the properties of a subterranean formation or production zone. The cement slurry may also include various additives to modify the hydraulic cement for a given pumping operation. For example, the cement slurry for an extended wellbore with a high bottom hole temperature may have chemicals added to decrease the pumping pressure, e.g., viscosity modifier, and to retard the set time for the temperature.

The cementing operation, also referred to as a primary cementing operation, can include various downhole equipment that can enhance the quality of the cement bond. A float shoe that includes one or more check valves can be coupled to the end of the casing string. The annular gap between the casing and the wellbore can be maintained by a plurality of casing centralizers. The cement slurry can be separated from the drilling fluids and various other fluids used in the pumping operations, e.g., spacer fluid, by pump down cementing plugs, wiper darts, wiper balls, foam balls, and various other pump down articles. The type of downhole equipment selected can depend on the well type, formation properties, drilling mud properties, wellbore environment, e.g., pressure and temperature, or a combination of factors.

The cement pumping operation can include one or more pumping units. The pumping units can include one or two mixing drums with high capacity pumps. The mixing system can include data acquisition system with pressure and density sensors. The cement pumping system can be trailer mounted or skid mounted.

The completion stage of the well construction can include perforating the casing string and fracturing the formation with proppant, e.g., sand. A blender, also referred to as a blender unit, may include a mixing system for blending proppant, e.g., sand, and water with various additives, e.g., friction reducers, to produce the proppant slurry. A plurality of high pressure pumps, also referred to as fracturing units, may deliver the proppant slurry into the wellbore with sufficient pressure to pump the proppant through the perforations to fracture the formation and deposit the proppant into the fractures.

Each stage of oil well construction may comprise various types of oilfield pumps with a unit controller that control the pumping operation based on a job design and feedback from various sensors on or connected to the pumps. The job design of each construction stage, e.g., cementing operation, can include a pumping procedure, a bill of materials, assigned pumping units, downhole equipment, and various chemicals for contingent operations. The pumping procedure can be loaded into the unit controller to direct the pumping operation of the assigned pumping units.

Figure 4A:
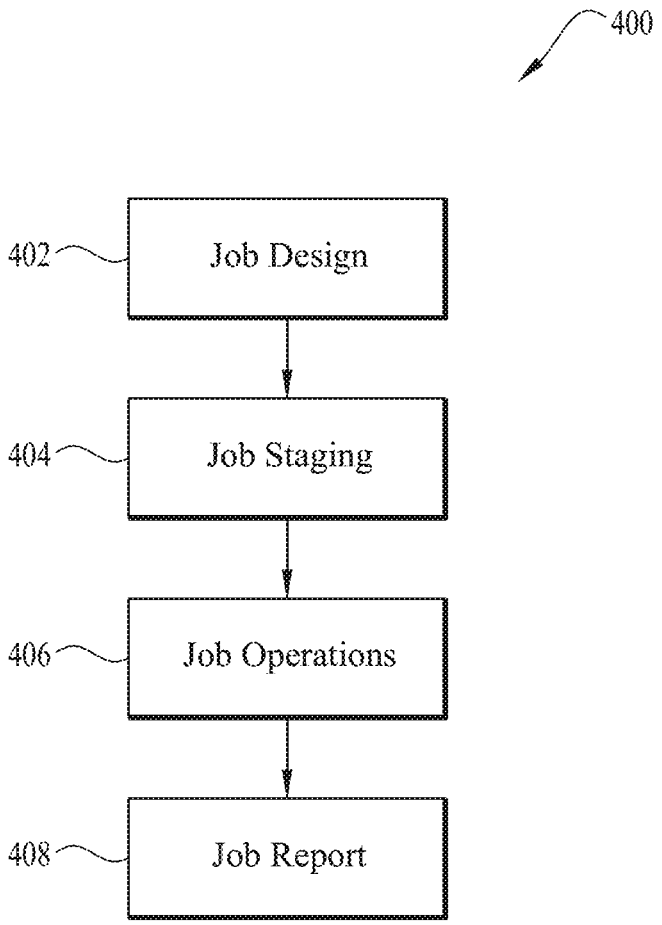
FIG. 4A is a logical flow diagram for a methodology of a wellbore pumping operation according to an embodiment of the disclosure.

A cementing job may have one or more objectives for the wellbore servicing operation to complete. The job design may include a series of steps, e.g., the pumping procedure, for completing the job objective. An engineer may generate a job design with the goal of completing the one or more job objectives. Turning now to FIG. 4A, a logical flow diagram depicting a methodology for a wellbore servicing operation 400 is illustrated. In an embodiment, the wellbore servicing operation 400 may include the steps of job design 402, job staging 404, job operations 406, and job report 408. The engineer may generate the job design 402 based on customer inputs, at least one job objective, a construction model, or combinations thereof. The wellbore servicing operation may be modeled by one or more application models to determine an operation characteristic, for example, hydraulic pumping pressures of the wellbore treatment fluid. The job design, including the pumping procedure, the bill of materials, an inventory of assigned pumping units, an inventory of downhole tools, various chemicals, or combinations thereof, may be submitted to the customer and/or service center for approval.

The wellbore servicing operation 400 can step to job staging 404 where the assigned pumping units are configured or selected from an available inventory of pumping units. The bill of materials for the treatment fluid, the downhole tool inventory, and various chemicals may be loaded onto a transport vehicle, skid, or basket for transport to the wellsite.

The equipment and materials assigned in the job staging 404 step may be transported to the wellsite in step of job operation 406. The service personnel may stage the equipment and materials about the wellsite. In some embodiments, the service personnel can fluidically connect the pumping equipment to the wellbore. In some embodiments, the service personnel may retrieve the job design including the pumping procedure before leaving the service center, before arriving at the wellsite, at the wellsite, or combination thereof. The pumping procedure may be loaded into a computer system communicatively connected to the pumping equipment, for example, on a unit controller. The service personnel may perform the wellbore treatment operation per the pumping procedure provided as part of the job design.

The service personnel may modify the job design, e.g., the pumping procedure, based on an unexpected occurrence within the wellsite environment or the wellbore environment. For example, the quality of the water supply at the wellsite can vary from the typical water available (for example, the water can be cloudy with minerals). In another scenario, the service personnel may encounter an unknown low pressure zone within the wellbore that results in fluid loss to the formation. The service personnel may contact the service center to request a design revision, for example, for a modified blend of treatment fluid. The engineer may have to iterate the design to find a blend that utilizes the materials loaded onto the transport during the job staging 404. In a worst case scenario, the materials needed for the design revision, e.g., modified blend, are not available at the wellsite and may need to be shipped from the service center (or other similar location) to the wellsite. The design revision to the job design and the shipping of materials to the wellsite can waste valuable time and resources. An improved method of generating a job design is needed.

Figure 4B:
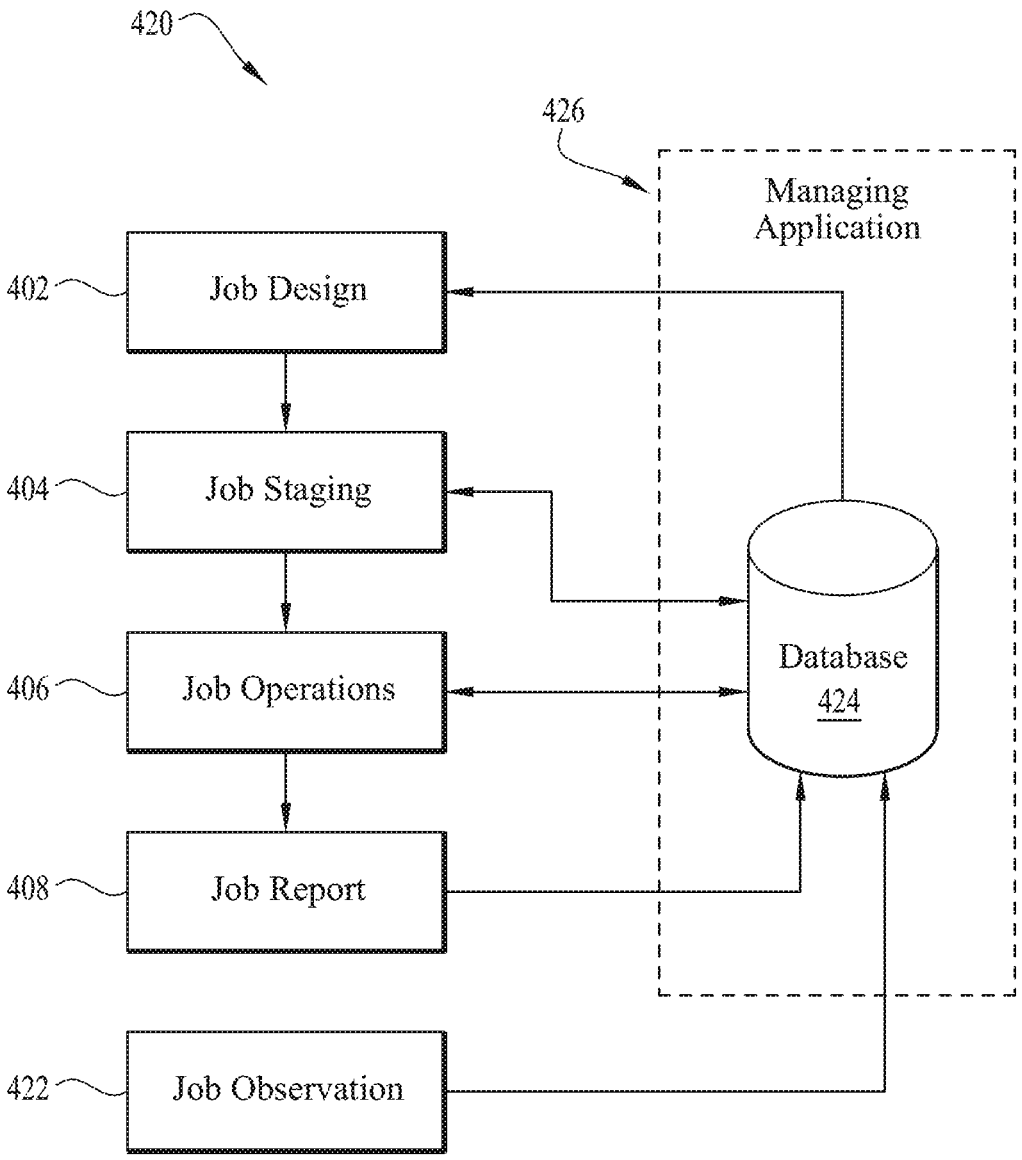
FIG. 4B is a logical flow diagram for a methodology of a wellbore pumping operation according to another embodiment of the disclosure.

A method of capturing feedback or additional details of the changes made to past job designs can improve future job designs. Turning now to FIG. 4B, a logical flow diagram depicting another methodology for a wellbore pumping operation 420 is illustrated. In some embodiments, a job observation 422 may be submitted by the service personnel to a managing application 426 for storage and retrieval from a database 424. The job observation 422 may include a description of the wellbore treatment, the servicing equipment, the pumping procedure, the wellsite environment, the downhole environment, or combinations thereof that effects the job design 402. From the previous example, the quality of the water supply at the wellsite can be a job observation 422 submitted by the service personnel. In another example, a job observation 422 can comprise the status of maintenance on a pumping unit and can be submitted during job staging 404. In another scenario, a job observation 422 can comprise the use of a fluid loss material during the drilling of a wellbore at a wellsite can be submitted during job operation 406. In still another scenario, a job observation 422 can comprise the size of a wellsite, e.g., drilling pad, can be submitted during the job report 408. The service personnel can classify the job observation 422 with searchable terms to enable future engineers to find the job observations 422 by searching with the managing application 426. An engineer generating a future job design 402 can try multiple searches of the database 424 with the managing application 426 to try to find data relevant to the job design 402, however the successful retrieval of job observations 422 may depend on the accurate classification of job observations 422 and the searching skills of the engineer generating the new job design. Relevant job observations 422 may be missed by the engineer searching the database because the job observations 422 have been forgotten, classified improperly, or recorded in an unknown format. An improved method of the retrieval and application of job observations 422 is needed.

One solution to the problem of classifying job observations can include a managing application, e.g., managing application 426, that classifies the job observations 422 with metadata. In an embodiment, the managing application can comprise a machine learning process 600 to apply metadata to the job observation 422. The metadata can include multiple groups or levels of metadata. For example, the managing application can classify and store the job observation 422 with a first and second level of metadata. Each level of metadata can include relevant data to the job observation 422, for example, drilling rig identification and wellsite location. The machine learning process can compare the job observation 422 to a training set of job observations 608 to determine the applicable metadata. The method of classifying job observations 422 can save time, increase efficiency, and improve data reporting.

Another solution to the problem of searching and applying job observations 422 to a job design 402 can include a managing application, e.g., managing application 426, that searches and retrieves job observations 422 from the database 424 during the drafting of the job design 402 by the engineer. The pumping procedures and bill of materials for the job design 402 may be drafted by one or more applications. In some embodiments, the managing application can compare the job design to a training set of job designs to determine metadata associated with the job design. In some embodiments, the managing application can search for applicable job observations 422 with the associated metadata during the job design 402. In some embodiments, the managing application can apply job observations 422 to the pumping procedures and/or bill of materials during the job design 402. The managing application can increase the accuracy and avoid down time of waiting for revisions to the job design by searching the database for job observations applicable to the job design in real-time.

Disclosed herein is a method of capturing job observations and applying searchable metadata. The job designs, job observations, and job reports can be stored into a database. The relevant job observations can be determined by a managing application during the job design. The application of the job observations to the job design can reduce the number of revisions to the job design and increase the efficiency of the job design process.

Turning now to FIG. 1, illustrated is an embodiment of a well environment 10 utilizing a job design determined by the design process. The servicing environment 10 comprises a servicing rig 4 that extends over and around a wellbore 12 that penetrates a subterranean formation 8 for the purpose of recovering hydrocarbons. The wellbore 12 can be drilled into the subterranean formation 8 using any suitable drilling technique. While shown as extending vertically from the surface 2 in FIG. 1, the wellbore 12 can also be deviated, horizontal, and/or curved over at least some portions of the wellbore 12. For example, the wellbore 12, or a lateral wellbore drilled off of the wellbore 12, can have a vertical portion 16, a deviated portion, and a horizontal portion 18. The wellbore 12 can be cased, open hole, or combination thereof. For example, a first portion extending from the surface can contain a string of casing 20 and a second portion can be a wellbore drilled into a subterranean formation 14. A primary casing string 20 can be placed in the wellbore 12 and secured at least in part by cement 24.

The servicing rig 4 can be one of a drilling rig, a completion rig, a workover rig, or other structure and supports cementing operations in the wellbore 12. The servicing rig 4 can also comprise a derrick, or other lifting means, with a rig floor 6 through which the wellbore 12 extends downward from the servicing rig 4. In some cases, such as in an off-shore location, the servicing rig 4 can be supported by piers extending downwards to a seabed. Alternatively, the servicing rig 4 can be supported by columns sitting on hulls and/or pontoons that are ballasted below the water surface, which can be referred to as a semi-submersible platform or floating rig. In an off-shore location, a casing can extend from the servicing rig 4 to exclude sea water and contain drilling fluid returns.

In some embodiments, the wellbore 12 can be completed with a cementing process that follows a cementing pumping procedure to place cement between the casing string 20 and the wellbore 12. Cement pumping equipment, also called pump unit 52, can be fluidly connected to a wellhead 50 by a supply line 58. The wellhead 50 can be any type of pressure containment equipment connected to the top of the casing string 20, such as a surface tree, production tree, subsea tree, lubricator connector, blowout preventer, or combination thereof. The wellhead 50 can anchor the casing string 20 at surface 2. The wellhead 50 can include one or more valves to direct the fluid flow from the wellbore and one or more sensors that gather pressure, temperature, and/or flowrate data. The service personnel can follow a cement pumping procedure with multiple sequential steps to place the cement slurry 34 into an annular space 42 between the casing string 20 and the wellbore 12. The service personnel can blend a volume of cement slurry tailored for the wellbore. The pump unit 52 can pump a predetermined volume of cement slurry though the supply line 58, through the wellhead 50, and down the casing string 20.

The cement slurry 34 can be Portland cement or a blend of Portland cement with various additives to tailor the cement for the wellbore environment. For example, retarders or accelerators can be added to the cement slurry to slow down or speed up the curing process. In some embodiments, the cement slurry 34 can be a polymer designed for high temperatures. In some embodiments, the cement slurry 34 can have additives such as fly ash to change the density, e.g., decrease the density, of the cement slurry.

In some embodiments, the pump unit 52 may include mixing equipment 54, pumping equipment 56, and a unit controller 60. The mixing equipment 54 can be in the form of a jet mixer, recirculating mixer, a batch mixer, a single tub mixer, or a dual tub mixer. The mixing equipment 54 can combine a dry ingredient, e.g., cement, with a liquid, e.g., water, for pumping via the pumping equipment 56 into the wellbore 12. The pumping equipment 56 can be a centrifugal pump, piston pump, or a plunger pump. The unit controller 60 may establish control of the operation of the mixing equipment 54 and the pumping equipment 56. The unit controller 60 can operate the mixing equipment 54 and the pumping equipment 56 via one or more commands received from the service personnel as will be described further herein. Although the pump unit 52 is illustrated as a truck, it is understood that the pump unit 52 may be skid mounted or trailer mounted. Although the pump unit 52 is illustrated as a single unit, it is understood that there may be 2, 3, 4, or any number of pump units 52 fluidically coupled to the wellhead 50.

In an embodiment, the pump unit 52 can be a mud pump fluidically connected to the wellbore 12 by the supply line 58. The mixing equipment 54 may blend or mix a dry mud blend with a fluid such as water or oil based fluid. The pump unit 52 may pump drilling mud mixed from dry mud blend and a fluid to the wellbore 12. The pump unit 52 may pump a water based fluid such as a completion fluid also called a completion brine.

In an embodiment, the pump unit 52 can be a blender fluidically connected to one or more high pressure pumping units, also called frac pumps or fracturing pumps. The mixing equipment 54 may blend or mix a proppant, e.g., sand or ceramic beads, with a fracturing fluid to produce frac slurry or fracturing slurry. The fracturing fluid may be water with one or more additives called slick water. The fracturing fluid may be water with a gel additive called gelled fluid. The pump unit 52 can pump the frac slurry to one or more frac pumps or directly to the wellbore 12. In some embodiments, the pump unit 52 can be a frac pump fluidically connected to the wellbore 12. The pump unit 52 may comprise the pumping equipment 56, e.g., plunger pump, and the unit controller 60. The pump unit 52 can receive a fluid, e.g., frac slurry, from a blender unit and pump the liquid to the wellbore 12.

In some embodiments, the well servicing environment 10 can include various downhole equipment specified by the job design. For example, a cementing operation can include one or more cement wiper plugs 36, a plurality of centralizers 40, and a float shoe 26. A set of centralizers 40 can be attached to the outside of the casing string 20 at determined intervals to centralize the casing string 20 within the wellbore 12. A cement wiper plug 36 can be pumped down the casing string 20 to physically separate the drilling fluid from the cement slurry 34. The cement wiper plug 36 comprises a plurality of flexible fins, or wipers, that sealingly engage the inner surface 38 of the casing 20 with a sliding fit. A volume of spacer fluid 44 or other type of completion fluid can be pumped after the cement wiper plug 36 to displace the cement wiper plug 36 down the casing string 20 to push the cement slurry 34 out the float shoe 26 (or other suitable primary cementing equipment) and into the annular space 42 between the casing string 20 and the wellbore 12.

The cement slurry 34 can be Portland cement or a blend of Portland cement with various additives to tailor the cement for the wellbore environment. For example, retarders or accelerators can be added to the cement slurry to slow down or speed up the curing process. In some embodiments, the cement slurry 34 can be a polymer designed for high temperatures. In some embodiments, the cement slurry 34 can have additives such as expandable elastomer particles.

Figure 2:
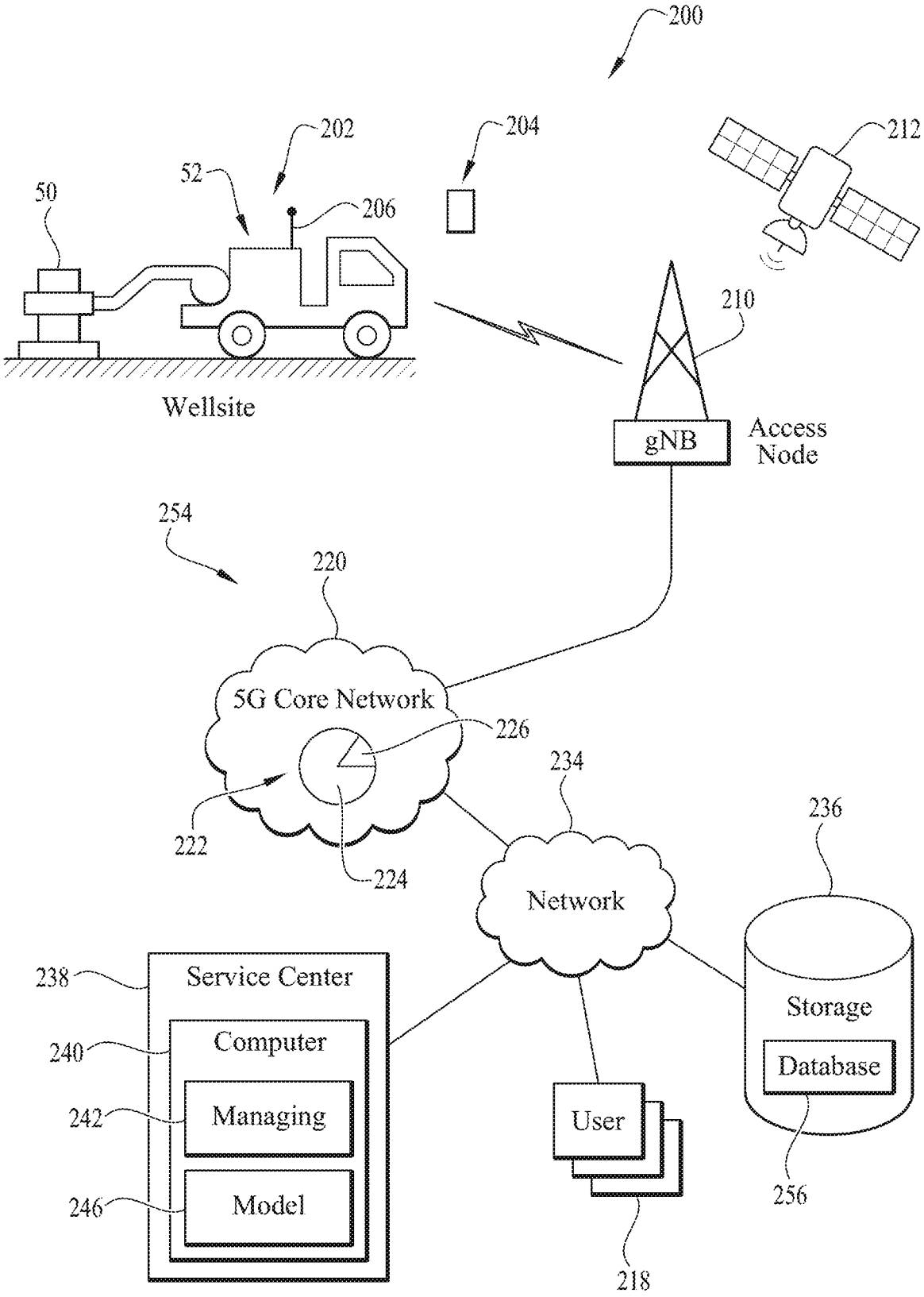
FIG. 2 is an illustration of a communication system according to an embodiment of the disclosure.

The service personnel can communicate changes to the job design by various wired or wireless means from a remote wellsite location. Turning now to FIG. 2, a data communication system 200 is described. The data communication system 200 comprises a wellsite 202 (where the pump unit 52 of FIG. 1 can be located), an access node 210 (e.g., cellular site), a mobile carrier network 254, a network 234, a storage computer 236, a service center 238, a plurality of user equipment (UE) 204, and a plurality of user devices 218. A wellsite 202 can include a pump unit 52 as part of a well construction operation pumping a service fluid into the wellhead 50 (e.g., wellhead 50 in FIG. 1). The pump unit 52 can include a communication device 206 (e.g., transceiver) that can transmit and receive via any suitable communication means (wired or wireless), for example, wirelessly connect to an access node 210 to transmit data (e.g., diagnostic log) to a storage computer 236. The storage computer 236 may also be referred to as a data server, data storage server, or remote server. The storage computer 236 may include a database 256 comprising job design data. Wireless communication can include various types of radio communication, including cellular, satellite 212, or any other form of long range radio communication. The communication device 206 can transmit data via wired connection for a portion or the entire way to the storage computer 236. The communication device 206 may communicate over a combination of wireless and wired communication. For example, communication device 206 may wirelessly connect to access node 210 that is communicatively connected to a network 234 via a mobile carrier network 254.

In some embodiments, the communication device 206 on the pump unit 52 is communicatively connected to the mobile carrier network 254 that comprises the access node 210, a 5G core network 220, and the network 234. The communication device 206 may be the radio transceiver 312 connected to the computer system 300 of FIG. 3. The computer system 300 may be the unit controller 60 of FIG. 1, thus the communication device 206 may be communicatively connected to the unit controller 60.

The UE 204 may be a communication device provided to the service personnel. In some embodiments, the UE 204 may be a computing device such as a cell phone, a smartphone, a wearable computer, a smartwatch, a headset computer, a laptop computer, a tablet computer, or a notebook computer. The UE 204 may be a virtual home assistant that provides an interactive service such as a smart speaker, a personal digital assistant, a home video conferencing device, or a home monitoring device. The UE 204 may be an autonomous vehicle or integrated into an autonomous vehicle. For example, the UE 204 may be an autonomous vehicle such as a self-driving vehicle without a driver, a driver assisted, an application that maintains the vehicle on the roadway with no driver interaction, or a driver assist application that adds information, alerts, and some automated operations such as emergency braking. The UE 204 may be the unit controller 60 on the pumping equipment, e.g., pump unit 52, or a computer system communicatively connected to the pumping equipment. The UE 204 may be a server computer.

Figure 3:
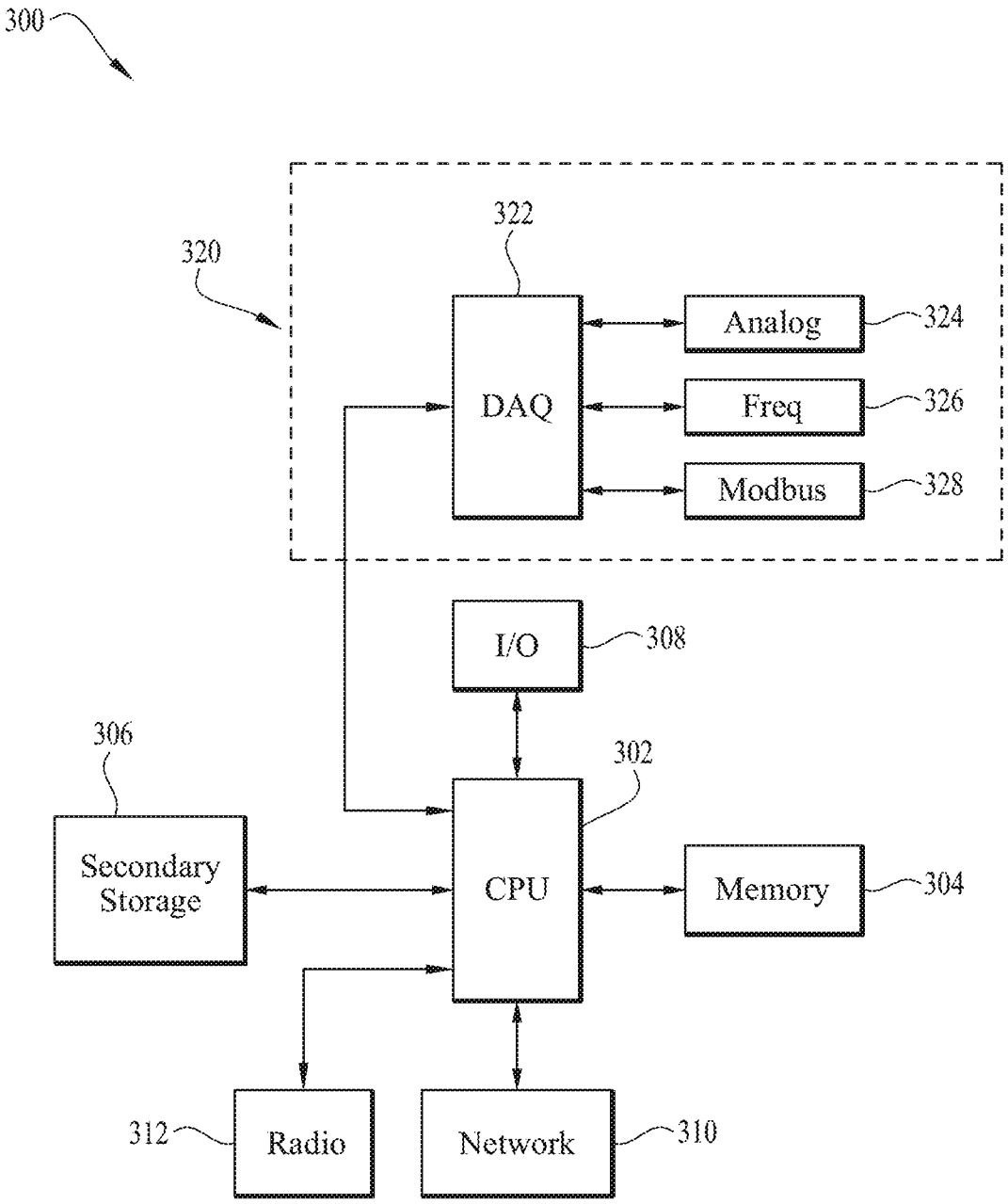
FIG. 3 is a block diagram of a computer system according to an embodiment of the disclosure.

Turning now to FIG. 3, the UE 204 and the unit controller 60 may be a computer system 300 with a processor 302, memory 304, secondary storage 306, and input-output devices 308. The UE 204 may establish a wireless link with the mobile carrier network 254 (e.g., 5G core network 220) and/or satellite 212 with a long range radio transceiver 312 to receive data, communications, and, in some cases, voice and/or video communications. The input-output devices 308 of the UE 204 may also include a display, an input device (e.g., touchscreen display, keyboard, etc.), a camera (e.g., video, photograph, etc.), a speaker for audio, or a microphone for audio input by a user. A network device 310 may include a short range radio transceiver to establish wireless communication with Bluetooth, WiFi, or other low power wireless signals such as ZigBee, Z-Wave, 6LoWPan, Thread, and WiFi-ah. The long range radio transceiver 312 may be able to establish wireless communication with the access node 210 based on a 5G, LTE, CDMA, or GSM telecommunications protocol. The UE 204 may be able to support two or more different wireless telecommunication protocols and, accordingly, may be referred to in some contexts as a multi-protocol device. The UE 204 may communicate with another UE via the wireless link provided by the access node 210 (or satellite 212) and via wired links provided by 5G core network 220, and the network 234. Although UE 204 is illustrated as a single device, UE 204 may be a system of devices. The unit controller 60 may include additional components and functionality such as secondary storage 306 and input-output module 320 as will be disclosed hereinafter.

The access node 210 may also be referred to as a cellular site, cell tower, cell site, or, with 5G technology, a gigabit Node B. The access node 210 provides wireless communication links to the communication device 206, e.g., UC 140 & 48, according to a 5G, a long term evolution (LTE), a code division multiple access (CDMA), or a global system for mobile communications (GSM) wireless telecommunication protocol.

The satellite 212 may be part of a network or system of satellites that form a network. The satellite 212 may communicatively connect to the UE 204, the communication device 206, the access node 210, the mobile carrier network 254, the network 234, or combinations thereof. The satellite 212 may communicatively connect to the network 234 independently of the access node 210.

The communication device 206 may establish a wireless link with the mobile carrier network 254 (e.g., 5G core network 220) with a long-range radio transceiver, e.g., 312 of FIG. 3, to receive data, communications, and, in some cases, voice and/or video communications. The communication device 206 may also include a display and an input device, a camera (e.g., video, photograph, etc.), a speaker for audio, or a microphone for audio input by a user. The long-range radio transceiver of the communication device 206 may be able to establish wireless communication with the access node 210 based on a 5G, LTE, CDMA, or GSM telecommunications protocol and/or satellite 212. The communication device 206 may be able to support two or more different wireless telecommunication protocols and, accordingly, may be referred to in some contexts as a multi-protocol device. The communication device 206, e.g., 206A, may communicate with another communication device, e.g., 206B, on a second pump truck, e.g., 52B, via the wireless link provided by the access node 210 and via wired links provided by the mobile carrier network 254, e.g., the 5G core network 220, and/or satellite 212. Although the pump unit 52 and the communication device 206 are illustrated as a single device, the pump unit 52 may be part of a system of pump units, e.g., a frac fleet. For example, a pump unit 52A may communicate with pump units 52B, 52C, 52D, 52E, and 52F at the same wellsite, e.g., 202 of FIG. 2, or at multiple wellsites. In an embodiment, the pump units 52A-E may be a different types of pump units at the same wellsite or at multiple wellsites. For example, the pump unit 52A may be a frac pump, pump unit 52B may be a blender, pump unit 52C may be water supply unit, pump unit 52D may be a cementing unit, and pump unit 52E may be a mud pump. The pump unit 52A-F may be communicatively coupled together at the same wellsite by one or more communication methods. The pump units 52A-F may be communicatively couple with a combination of wired and wireless communication methods. For example, a first group of pump units 52A-C may be communicatively coupled with wired communication, e.g., Ethernet. A second group of pump units 52D-E may be communicatively couple to the first group of pump units 52A-C with low powered wireless communication, e.g., WIFI. A third group of pump units 52F may be communicatively coupled to one or more of the first group or second group of pump units by a long range radio communication method, e.g., mobile carrier network 254.

The 5G core network 220 can be communicatively coupled to the access node 210 and provide a mobile communication network via the access node 210. The 5G core network 220 can include a virtual network (e.g., a virtual computer system) in the form of a cloud computing platform. The cloud computing platform can create a virtual network environment from standard hardware such as servers, switches, and storage. The total volume of computing availability 222 of the 5G core network 220 is illustrated by a pie chart with a portion illustrated as a network slice 226 and the remaining computing availability 224. The network slice 226 represents the computing volume available for storage or processing of data. The cloud computing environment is described in more detail further hereinafter. Although the 5G core network 220 is shown communicatively coupled to the access node 210, it is understood that the 5G core network 220 may be communicatively coupled to a plurality of access nodes (e.g., access node 210), one or more mini-data center (MDC) nodes, or a 5G edge site. The 5G edge site may also be referred to as a regional data center (RDC) and can include a virtual network in the form of a cloud computing platform. Although the virtual network is described as created from a cloud computing network, it is understood that the virtual network can be formed from a network function virtualization (NFV). The NFV can create a virtual network environment from standard hardware such as servers, switches, and storage. The NFV is more fully described by ETSI GS NFV 002 v1.2.1 (December 2014).

The network 234 may be one or more private networks, one or more public networks (e.g., the Internet), or a combination thereof. The network 234 can be communicatively coupled to the 5G core network 220 and the cloud network platform.

The service personnel can retrieve a job design with the UE 204 from the database 256 on the storage computer 236. In some embodiments, the service personnel can communicatively connect the UE 204 (the UE 204 can include the unit controller 60 on the pump unit 52) to the storage computer 236 via the mobile carrier network 254. The UE 204 can retrieve and store the job design from the database 256.

The service personnel can submit job observations, e.g., job observation 422, to the database 256. In some embodiments, the service personnel can record a job observation with a UE 204, communicatively connect the UE 204 to the database 256, and transmit the job observation to the database 256 for storage. The job observation may include a description, a location of the UE 204, and observation input data including audio, video, video conferencing, photograph, data entry, or combinations thereof.

A requested change to a job design can be submitted via a UE 204 to a user device 218, e.g., a computer system. The user device 218 may be a tablet computer, laptop computer, desktop computer, or any other computer system. In some embodiments, a requested change can be made with a job observation or a direct request submitted via the UE 204. The user device 218 can receive the request directly or retrieve a request and/or observation from the database 256. The user device 218 (in some contexts, the engineer using the computer system) may input the request and/or the job observation to a managing application 242 (the managing application 242 may be an embodiment of the managing application 426 of FIG. 4B) executing on a computer system 240 within the service center 238. The user device 218 can revise the job design with the managing application 242 and in some cases one or more models 246. The models 246 may include wellbore construction models or applications with processes (e.g., mathematical models) to simulate wellbore treatments within the wellbore environment. The models 246 can include a casing design model, a casing stretch model, a cement strength model, a well control model, a formation strength model, a dynamic loading models, or any other model that describes the wellbore environment. The models 246 can include wellbore treatment models that simulate the wellbore treatment in the wellbore environment such as hydraulic modeling of fluid flow, computational fluid dynamics, future stress states of wellbore barriers, or other such applications. The revised job design can be stored in the database 256 for retrieval by the service personnel or sent directly to the UE 204.

At the completion of a wellbore servicing operation, the user device 218 can submit a job report 408 to the database 256. The job report 408 may describe the job objective, the job design 402, and the outcome of the wellbore servicing operation. The job report 408 may include a list of materials, downhole tools, an inventory of pump equipment (e.g., pump unit 52), and various chemicals used during the wellbore operation. The job report 408 may describe the completion or status of the job objective. If the job objective was not met, the job report 408 may include a root cause analysis of the material, servicing equipment, or wellbore environment that prevented the job objective from being successfully completed.

The managing application 242 can use a machine learning process to recognize unplanned changes to a job design, e.g., job observations, and categorize the job observations to facilitate retrieval from the database 424. The managing application 242 (e.g., managing application 426) may assign metadata tags to a job observation 422 to increase the searchable fields so that the job observation 422 may be found and applied to future job designs with similar characteristics, e.g., metadata tags. Returning to FIG. 4B, in some embodiments, the managing application 426 can receive a job observation 422 from one or more of the UE 204. The managing application 242 can search all or a portion of the job observation, for example, a description field of the job observation 422 for data, e.g., material name, and apply a metadata tag relevant to the data within the description. In other scenarios the service personnel may enter relevant data into data fields within the job observation 422. In still another scenario, the service personnel may submit an image, a video, or download a relevant dataset from equipment at the wellsite 202. In some embodiments, the job observation 422 can be captured from the active well servicing operation, e.g., pump unit executing a pumping procedure from the job design 402. The service personnel may execute the managing application 242 on the unit controller 60 on the pump unit 52 of FIG. 1 to record a dataset, capture an incident, or submit a revision to the pumping procedure that generates a job observation 422. The managing application 426 can generate the job observation 422 and/or receive the job observation 422 and employ a machine learning process that compares the job observation 422 to a training set of job observations to identify at least one metadata tag to apply to the job observation 422. The training set of job observations comprise an observation description, an observation object, and a set of metadata tags. The machine learning process identifies the set of metadata tags based on the training set of job observations that match the job observation 422. The metadata tags can be selected from a group of metadata tags as will be described hereinafter. In another scenario, the user, e.g., service personnel, may apply the metadata to the job observation 422. In still another scenario, a plurality of predetermined input fields on the job observation 422 may contain the metadata tags. In some embodiments, the user device 218 may generate a job observation 422 with the managing application 242 executing on the computer system 240, with the managing application 242 executing on UE 204, with the managing application executing on network slice 226 of the 5G core network 220, or combinations thereof. For example, the user device 218 may generate a job observation 422 at the service center during the job staging 404 of the pumping equipment. The user device 218 may use the managing application 426 executing on a UE 204 to generate the job observation 422. The managing application 426 on the UE 204 may transmit the job observation 422 to a machine learning process executing on the network slice 226 of the 5G core network 220, a machine learning process executing on computer system 240, or combinations thereof to process the metadata tags for the job observation 422.

Figure 5:
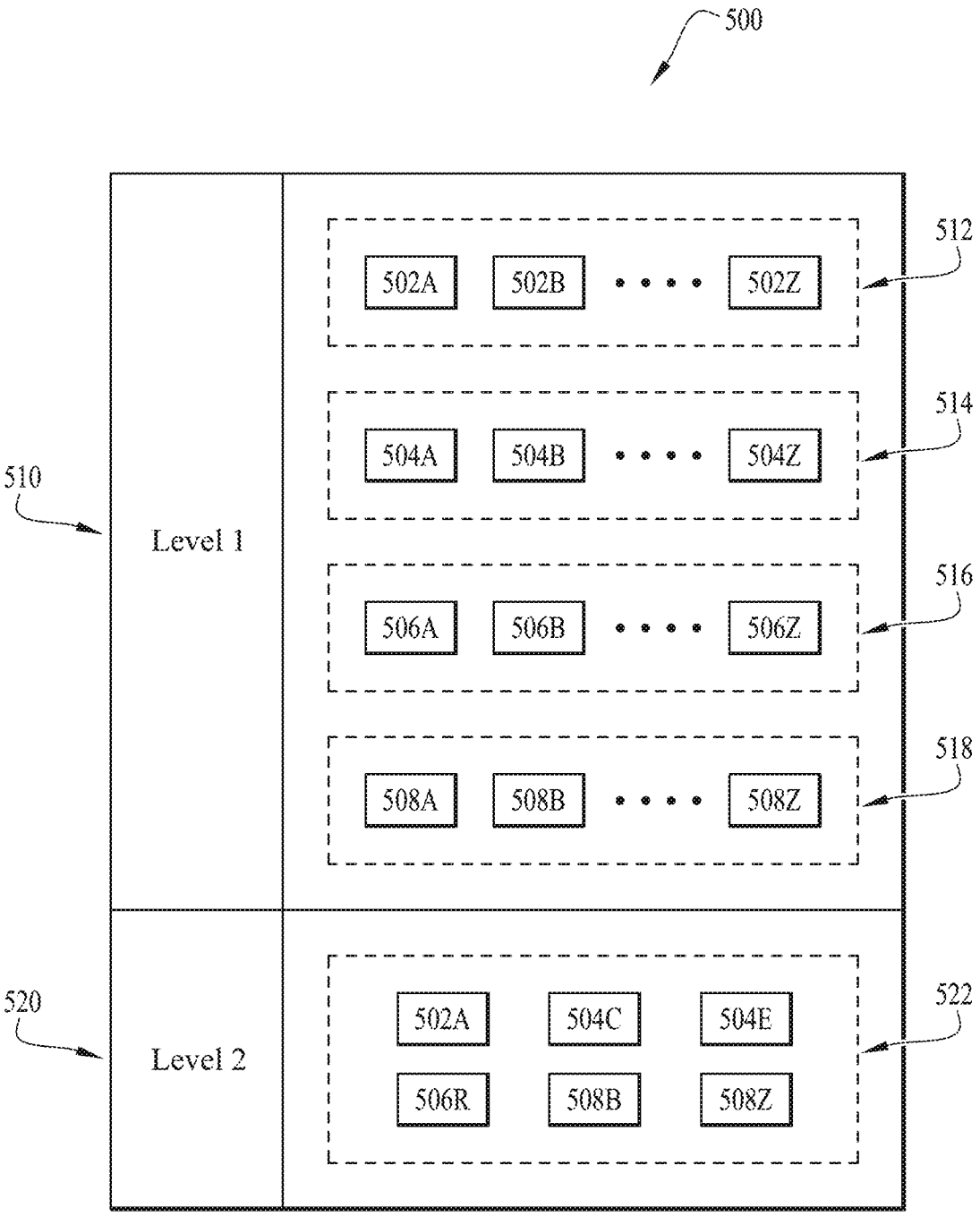
FIG. 5 is a table depicting five groups of metadata according to an embodiment of the disclosure.

Turning now to FIG. 5, a table illustrating a set of metadata tags 500 can be described. The metadata tags are descriptive information that can be stored within a digital file structure to inform the user of the content of the digital file. The metadata tags can be read by a search engine to include or exclude the digital file from a set of search results. The metadata tags can be descriptive, structural, or administrative type of metadata. Descriptive metadata can be discovery, e.g., data is included in the digital file, and identification, e.g., the data value. For example, the metadata can provide the geolocation data of the wellsite. Structural metadata can describe how the data is organized. For example, the metadata can describe the type and number of data points for a dataset of periodic pumping data. Administrative metadata can describe when and what device generated the digital file. Although three types of metadata are described, it is understood that those types are examples of metadata and that the metadata may include additional types or sub-types of metadata not listed. In some embodiments, the set of metadata tags 500 comprises at least two groups that can include at least two categories. In some embodiments, a first group 510 of metadata tags may be referred to as level 1 metadata comprising at least two categories of metadata tags. A first category 512 of metadata tags (e.g., metadata 502A-Z) can include descriptive and administrative types of metadata for file information and job information. For example, the first category 512 may comprise metadata tags for job reference number 502A, a customer identification 502B, a location 502C, a time and/or date stamp 502D, a drilling/production rig name 502E, or combinations thereof. Although metadata tags 502A-502E are described, it is understood that the metadata tags 502A-502E are an example and that the first category of metadata tags can include any number of metadata tags from 502A-502Z. The location may comprise a geolocation data including GPS data, a location based on mobile communication triangulation, a map location, a mineral lease location, or combination thereof. A second category 514 of metadata tags (e.g., metadata 504A-Z) can include descriptive metadata comprising a material (e.g., dry ingredient), a chemical (e.g., an additive), a fluid (e.g., water), a treatment blend (e.g., dry cement blend), an inventory of operational equipment including pumping fleet units and auxiliary equipment (e.g., frac iron), an inventory of downhole tools (e.g., centralizers), a wellsite equipment (e.g., type of wellhead), a safety observation (e.g., reduced operational capacity of wellsite equipment), and wellsite regional location (e.g., directions to wellsite). A third category 516 of metadata tags (e.g., metadata 506A-Z) can include descriptive and structural metadata comprising a downhole environment (e.g., types of data and data values), a surface environment (e.g., types of data and data values), or combinations thereof. For example, the downhole environment metadata tags may include bottom hole temperature (e.g., temperature value), bottom hole pressure (e.g., pressure value), wellbore path (e.g., table of wellbore inclination and depth), formation top location (e.g., depth value), formation minerology (e.g., table of minerology type and depth), formation fluids (e.g., density and rheology), or any other environmental dataset. The surface environment may include daytime temperatures (e.g., temperature value), night time temperatures (e.g., temperature value), height of the wellhead (e.g., distance value), condition of the land (e.g., description), or any other environmental description. A fourth category 518 of metadata tags (e.g., metadata 508A-Z) may include descriptive and structural metadata comprising a portion of the pumping procedure, e.g., a table of a stage or series of steps of a pumping procedure. For example, the fourth category 518 may include a table of the time, depth, and circulation pressures encountered during drilling that required a fluid loss material treatment be pumped from the mud system. In some embodiments, a second group 520 of metadata tags may be referred to as level 2 metadata comprising a combination 522 of selected metadata tags from the first group 510 of metadata tags. The level 2 metadata can provide a combination 522 of the relevant metadata tags for a job observation into a group (e.g., second group 520). This combination 522 of metadata tags (e.g., 502A) can provide reduced set of metadata tags (e.g., 502A) for the search engine to find. For example, the level 2 metadata (e.g., the second group 520) may contain a combination of location and rig (first category 512), fluid, wellsite equipment, and safety (second category 514), surface equipment (third category 516), and a portion of the pumping procedure including the maximum pump pressure (fourth category 508). In this example, the level 2 metadata tags (e.g., the second group 520) can provide a combination 522 of metadata tags to communicate that future well services must limit the maximum pump pressure below a reduced threshold working pressure of a wellhead that is over 30 years old. Although the set of metadata tags 500 is illustrated as comprising a first group 510 with 5 categories 512-518 of metadata tags, it is understood that there may be 1, 2, 3, 4, 5, 6, 7, 8, 9, 10, 11, 12, or any number of groups and/or categories of metadata tags.

The training set of job observations can comprise metadata selected from the first group 510 of metadata and a combination 522 of metadata from the level 2 metadata (e.g., the second group 520). The metadata tags from the first group 510 and the combination 522 of metadata can be indicative of the job observation description and observation object.

The managing application 242 can utilize a machine learning process to generate one or more job observations 422 from job reports 408 stored in a historic database. Returning to FIG. 2, the user device 218 can direct the managing application 242 can compare a job report 408 to a corresponding job design 402 to generate a job observation 422 from the determined changes made to the job design 402. With reference to FIG. 4B, in some embodiments the managing application 242 (an embodiment of managing application 426) may retrieve a job report 408 and a job design 402 from the database 424. In some scenarios, the job report 408 and job design 402 are from recent jobs that include metadata associated with the respective files. In other scenarios, the job report 408 and job design 402 may be from past jobs without metadata. It is understood that the job report 408 corresponds to the job design 402 or stated another way, the job report 408 is a direct result of the job design 402 taken to the wellsite 202 by the servicing personnel.

The managing application 242 may retrieve the job report 408 and job design 402 from the database 424. The managing application 242 may utilize a machine learning process to apply metadata tags to the job report 408 by comparing the job report 408 to a training set of job reports. The metadata tags may include metadata tags selected from a first group 510 of metadata tags. The machine learning process may determine and apply a combination 522 the metadata tags selected from the first group 510. The machine learning process may apply metadata from a first group 510 to the job design 402 by comparing the job design 402 to a training set of job designs. The machine learning process may determine and a apply a combination 522 the metadata tags selected from the first group 510. The machine learning process may determine a job change value by comparing the metadata within the job report 408 to the metadata within the job design 402. The machine learning process can search for a job observation 422 with the level 2 metadata comprising the combination 522 of relevant metadata tags (e.g., 502A) corresponding to the job change and generate a job observation 422 with the level 1 and level 2 metadata in response to not finding an existing job observation 422. In some scenarios, the machine learning process may submit the job observation 422 to the service personnel, engineer, or other designee for approval. In other scenarios, the machine learning process may generate a notification and/or alert within the job observation 422 to inform the engineer that the job observation 422 was generated by the managing application 426.

From a prior example, a service personnel may discover the water on an offshore rig is cloudy with minerals. The service personnel can submit a job observation 422 describing the water quality, the resultant density of the cement, and the modifications to the cement blend to compensate for the water quality. The job observation 422 may include metadata tags from the first group 510 including job reference, customer, rig name, location, job objective, fluid type, cement blend, and density. The machine learning process may compare the job observation 422 to a training set of job observations to determine a level 2 metadata (second group 520) combination of rig name, fluid type, cement blend, and density. The machine learning process may determine that the metadata tag for customer, location, and job objective is not relevant to the job observation 422, however the rig name where the fluid type (e.g., water) is found is relevant.

Figure 6:
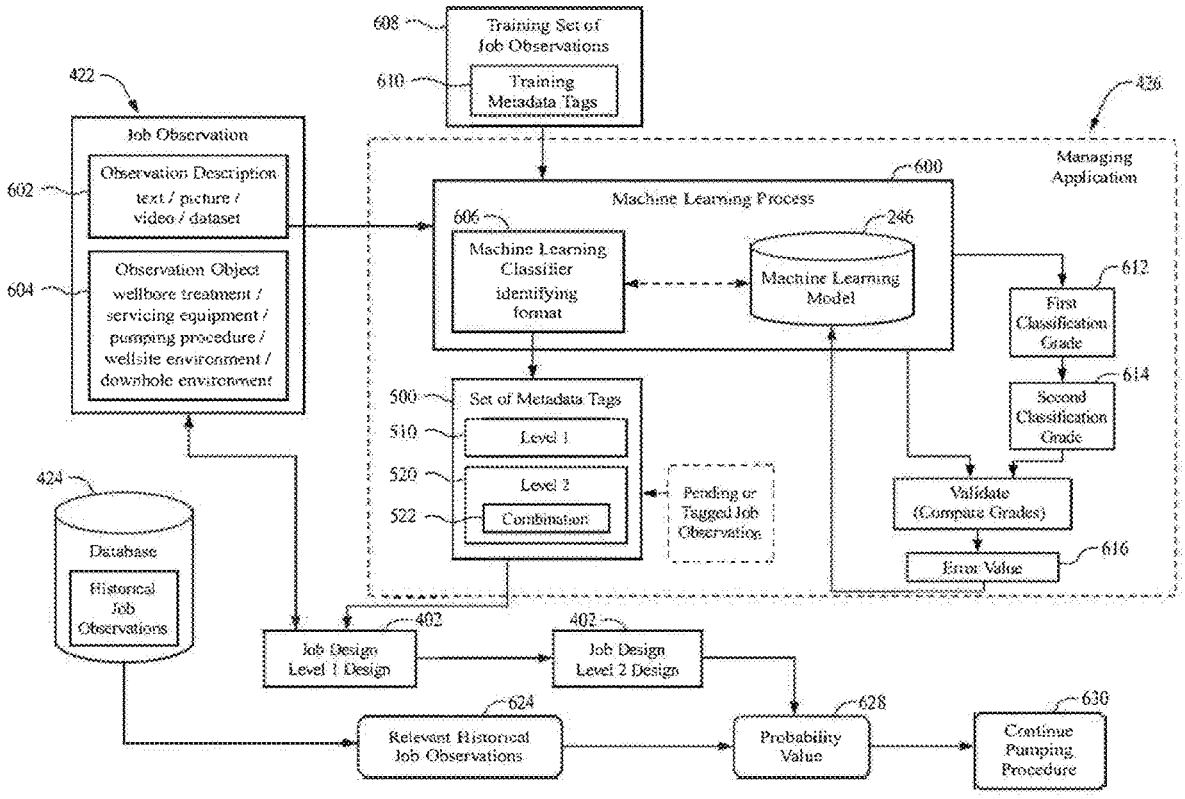
FIG. 6 is a block diagram illustrating a system of training a machine learning model for constructing a wellbore, according to an embodiment of the disclosure.
Figure 7:
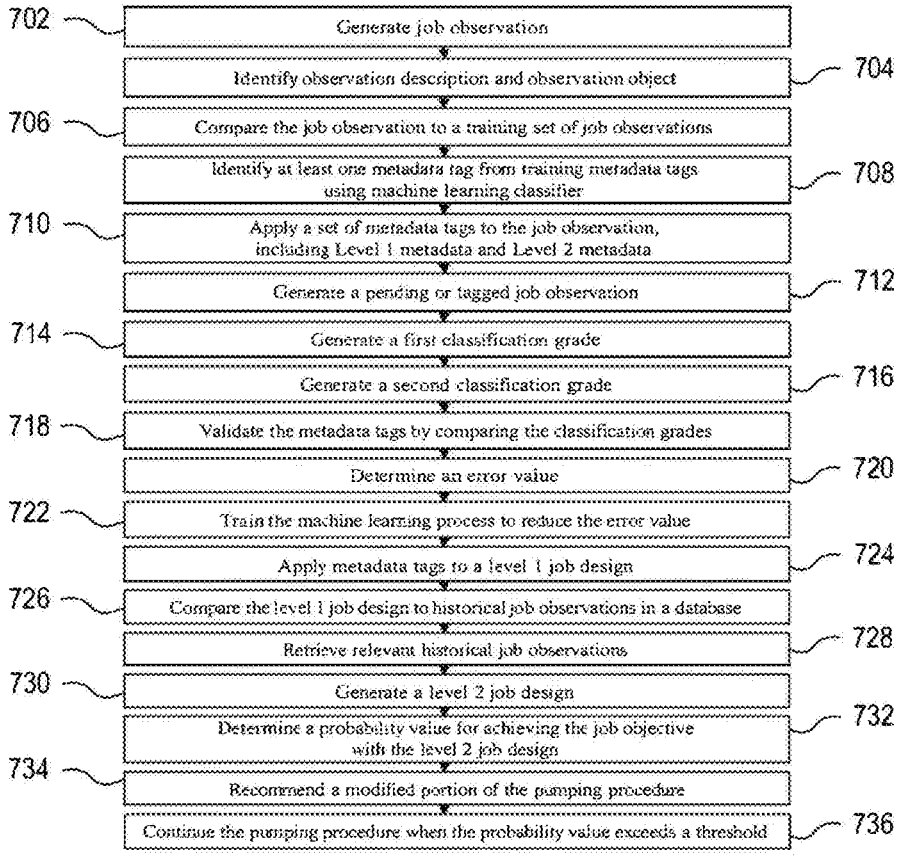
FIG. 7 is a flow diagram illustrating steps of a method of training a machine learning model for constructing a wellbore, according to an embodiment of the disclosure.

Referring also to FIGS. 6 and 7, disclosed herein is a method of training a machine learning process 600 to apply metadata tags to job observations by grading the metadata tags based on the ranking of search results within the database. In some embodiments, the machine learning process may be utilized by the managing application 242 executing on a computer system (e.g., a virtual computer on the network slice 226) to generate, at step 702, a job observation 422 comprising an observation description 602 and an observation object 604. The observation description 602 comprises a text description, picture description, video description, at least one dataset, or combinations thereof, and wherein the at least one dataset is a dataset of measured field data, a dataset of periodic data, or combinations thereof. The observation object 604 comprises a wellbore treatment, a servicing equipment, a pumping procedure, a wellsite environment, a downhole environment, or combinations thereof. The machine learning process may utilize a machine learning classifier 606 to identify a format of the job observation 422, at step 704. The format of the job observation 422 comprises the observation description 602 and the observation object 604. The machine learning classifier 606 can compare, at step 706, the job observation 422 to a training set of job observations 608 to identify, at step 708, at least one metadata tag (e.g., 502A) from the training set of job observations 608. The machine learning process 600 can apply, at step 710, a set of metadata tags 500 to the job observation 422 where the at least one metadata tag (e.g., 502A) is selected from a set of metadata tags 500. The set of metadata tags 500 may comprise at least two groups of metadata tags, for example, a first group 510 and a second group 520. The machine learning classifier 606 may generate, at step 712, a pending job observation by applying the set of metadata tags 500 to the job observation 422 by comparing a training set of job observations comprising training metadata tags 610 to the pending job observation comprising the description and the observation object. The set of metadata tags 500 and the job observation 422 are inputs to the machine learning process 600. The machine learning process 600 may generate a classification grade by searching a database 424 for a pending job observation with a search criterion comprising the combination 522 of the relevant metadata tags within the second group 520. The classification grade of the pending job observation with the combination 522 of metadata tags can be determined by comparing a classification grade from searching the database to a classification grade from at least one existing job observation corresponding to the set of metadata tags. The classification grade can be a ranking value of the search results determined by the placement (how high the pending observation ranks) within the set of search results. The machine learning process 600 may validate, at step 718, the first group 510 and second group 520 of metadata tags selected from the first group 510 of the set of metadata tags 500 by comparing a first classification grade 612 (step 714) using a first combination 522 of metadata tags to a second classification grade 614 (step 716) using a second combination 522 of metadata tags to determine, at step 720, an error value 616. The machine learning process 600 is trained, at step 722, to reduce the error value 616 by changing or modifying the combination 522 of metadata tags applied to the job observation.

Referring also to FIGS. 6 and 7, the managing application 242 can use a machine learning process 600 to suggest changes to a job design based on historical job observations stored with the database 424. In some embodiments, the managing application 242 may be executing on a computer system (e.g., computer system 240) utilizing a machine learning process 600 to compare the plurality of historical job observations (e.g., job observation 422) within the database 424 to a job design 402 that is in the drafting stage (e.g., a level one job design). The managing application 242 can compare the job design 402 to a training set of job designs to apply, at step 724, metadata tags (set of metadata tags 500 from FIG. 5) to the job design 402 and search, at step 726, the database 256 for relevant historical job observations 624, e.g., job observations 422 with a combination 522 of metadata tags that exceed a comparison value. The managing application can identify a set of relevant historical job observations (e.g., job observation 422 with the combination 522 of metadata tags), retrieve, at step 728, the set of relevant historical job observations 624, and present the set of relevant job observations to the user device 218, e.g., the computer system. In some embodiments, the managing application 242 can identify a set of relevant job observations, modify the job design 402 (e.g., generate, at step 730, a level two job design), alert the user to the revised job design (e.g., job design 402), the set of relevant job observations 422, or combinations thereof. The managing application may modify the job design 402 and may utilize one or more models 246 to analyze the job design 402. In some embodiments, the managing application 242 may utilize machine learning to determine, at step 732, a probability value 628 for achieving the job objective with the modified job design (e.g., level two job design). The probability value for achieving a job objective or a portion of a job objective can be based on a mathematical model, e.g., a probability model, utilizing historical data, e.g., job reports. The probability model can be utilized to determine a probability value for the job design (e.g., level one job design) and/or a change to the job design (e.g., level two job design) based on historical data.

In some embodiments, the user device 218, e.g., engineer utilizing a laptop, may access the managing application 242 executing on the computer system 240 within the service center 238 to perform a search for relevant job observations 422. In some embodiments, the managing application 242 may determine the combination 522 (e.g., level 2 metadata) of the metadata tags (e.g., 502A) relevant to the job design 402 to search the database 424 for job observations 422 with matching combinations 522 of metadata tags. In some embodiments, the user device 218 may provide the combination 522 of metadata tags to search the database 424 for relevant job observations. The managing application 242 may present a set of relevant job observations retrieved from the database 424 to the user device 218. The user device 218 (in some scenarios, an engineer using the laptop) may modify the job design 402 (from a level one to a level two) based on one or more of the set of relevant job observations.

In some scenarios, the user device 218 may access the managing application 426 executing on a network slice 226 within the 5G core network 220 to review and revise the job design 402. In some embodiments, the user devices 218 (e.g., the service personnel) may access the managing application 426 executing on the UE 204. In some embodiments, the user devices 218 (e.g., service personnel) may access the managing application 426 on the UE 204 and on the network slice 226. For example, the managing application 426 may transfer a portion of the process, e.g., the machine learning process, from the UE 204 to the network slice 226.

In some embodiments, the managing application 426 may predict a change to the job design based on past job observations. The managing application 426 may utilize a machine learning process to predict a job observation 422, e.g., a change, for a job design 402. The managing application 426 may retrieve one or more job observations, e.g., job observation 422, from the database 424. The managing application 426 may generate a probability value 628 of a change to the job design 402 based on a set of job observations. The managing application may modify the job design 402 (from a level one to a level two) based on the probability value. The modification of the job design 402 (e.g., level two job design) may include a change to the pumping procedure, a change to the material (e.g., cement blend), adding additional materials to the bill of materials, modifying the various chemicals, adding and/or modifying the inventory of downhole equipment, modifying the inventory of pump units, or combinations thereof. For example, the managing application 426 may retrieve a set of job observations comprising a customer probability of changing the tubing size (e.g., casing string 20) to a smaller size in some situations. A fluid loss treatment that is included in the job design 402 for this particular job may prematurely set or harden and not reach the target depth in the concentration needed with a smaller tubing size. The managing application 426 may modify the inventory of various chemicals to include a fluid loss treatment suitable for smaller tubing sizes. In some embodiments, the managing application 426 may alert the user device 218, e.g., a laptop, of the recommended modification, at step 734.

The managing application 426 can use a machine learning process 600 to recognize unplanned changes during a wellsite fluid treatment operation, e.g., cementing operation, generate a job observation, and retrieve a job design or portion of a job design that matches the job observation, e.g., the unplanned changes. The managing application 426 may be executing on a UE 204, for example the unit controller 60 of the pump unit 52, during a pumping operation placing a wellbore treatment fluid into the wellbore 12 of FIG. 1. The managing application 426 may be directing the pumping operation via the pumping procedure provided by the job design 402 to place the wellbore treatment materials (e.g., cementing blend) into the wellbore 12. The UE 204 may be receiving a plurality of datasets indictive of the pumping operation from sensors communicatively connected to the mixing equipment 54, the pumping equipment 56, the wellhead 50, at least one downhole tool (e.g., centralizer 40), or combinations thereof. The UE 204 may receive a plurality of datasets indictive of a change to the pumping procedure. For example, a change in the wellbore environment, e.g., a low pressure zone, can necessitate the modification of the treatment materials (e.g., wellbore treatment fluid), the addition of various chemicals (e.g., a fluid loss treatment), a change to the pumping procedure (e.g., lower pumping pressures or volumes), a downhole tool (e.g., a drop bar), or combinations thereof. The managing application 426 may generate a job observation 422 that may comprise an operational dataset (e.g., sensor data indicative of the pumping operation), the pumping procedure, a portion of the pumping procedure (e.g., completed pumping procedure), and the current step (also referred to as a stage) of the pumping procedure, identification data, or combinations thereof. The machine learning process may compare, at step 706, the job observation 422 to a training set of job observations 608 to determine the metadata tags (step 708) (e.g., 502A) from the first group 510 of metadata (e.g., level 1 metadata) and a combination 522 of metadata tags (e.g., level 2 metadata). The machine learning process may compare the combination 522 of metadata tags (e.g., 502A) to the historical job observations within the database 424 to retrieve, at step 728, a set of historical job observations 624 with a combination of metadata tags that exceed a comparison value threshold. The comparison value may be a ranking value (e.g., rank 3 of 1,200) or a percentage match (e.g., 88% matching). Likewise, the comparison value threshold may be ranking value threshold (e.g., above ranking value #20) or a percentage matching threshold (e.g., above 75%). The machine learning process may retrieve the historical job designs and historical job reports that correspond to the set of historical job observations to determine a change to the portion of the job design 402 (step 732) by comparing the job design to the historical job designs and job reports. The machine learning process may modify the current job design (e.g., a revision one) to a modified job design (e.g., a revision two). The managing application 426 may execute the modified job design (the revision two) to continue, at step 736, the wellbore treatment operation (continue pumping procedure 630). In some embodiments, the managing application 426 may alert the service personnel to one or more changes to the job design 402. The managing application 426 may modify the current job design to a modified job design in response to the service personnel selecting or electing the one or more changes received from the machine learning process. For example, a drilling mud pumping operation may detect a change in the volume of returns to surface indicative of production fluids entering the wellbore 12. The managing application 426 may generate a job observation 422 and transmit the job observation 422 via the communication device 206. The machine learning process may compare the job observation 422 to the plurality of job observations in the database 256 and retrieve a set of relevant job observations 624. The machine learning process may retrieve the job design and job reports corresponding to the set of job observations. The managing application 426 may modify the job design 402 active within the UE 204 per the modified pumping operation received from the machine learning process. The machine learning process may determine a probability value 628 for achieving the job objective by modifying the job design. For example, the managing application 426 may modify the weight of the wellbore treatment fluid (e.g., drilling mud) and the pressure and pump rate of the pump unit 52 in response to the modified pumping operation.

As previously described, the UE 204, user device 218, and unit controller 60 may be a computer system suitable for collecting data, storing data, processing data, communicating data, and in some cases, control of the pump unit 52. In FIG. 1, the unit controller 60 may establish control of the operation of the mixing equipment 54 and the pumping equipment 56 of the pump unit 52. In FIG. 2, the UE 204 and user device 218 may collect data, process data, and transmit data to one or more storage locations, e.g., database 256. In some embodiments, the unit controller 60 and/or UE 204 may be an example of computer system 300 described in FIG. 3. Turning now to FIG. 3, a computer system 300 suitable for implementing one or more embodiments of a UE including without limitation any aspect of the computing system associated with UE 204 and/or user device 218 of FIG. 2. The computer system 300 includes one or more processors 302 (which may be referred to as a central processor unit or CPU) that is in communication with memory 304, secondary storage 306, input-output devices 308, radio transceiver 312, and network devices 310. The computer system 300 may continuously monitor the state of the input devices and change the state of the output devices based on a plurality of programmed instructions. The programming instructions may comprise one or more applications retrieved from memory 304 for executing by the processor 302 in non-transitory memory within memory 304. The input-output devices 308 may comprise a human machine interface (HMI) with a display screen and the ability to receive conventional inputs from the service personnel such as push button, touch screen, keyboard, mouse, or any other such device or element that a service personnel may utilize to input a command to the computer system 300. The secondary storage 306 may comprise a solid state memory, a hard drive, or any other type of memory suitable for data storage. The secondary storage 306 may comprise removable memory storage devices such as solid state memory or removable memory media such as magnetic media and optical media, i.e., CD disks. The computer system 300 can communicate with various networks with the network devices 310 comprising wired networks, e.g., Ethernet or fiber optic communication, and short range wireless networks such as Wi-Fi (i.e., IEEE 802.11), Bluetooth, or other low power wireless signals such as ZigBee, Z-Wave, 6LoWPan, Thread, and WiFi-ah. The computer system 300 may include a long range radio transceiver 312 for communicating with mobile network providers as will be disclosed further herein.

The computer system 300 may have an additional input-output module 320 capable of collecting data from and controlling equipment communicatively connected to the computer system 300. The computer system 300 suitable for implementing one or more embodiments of a unit controller including without limitation any aspect of the computing system associated with pump unit 52 of FIG. 1 and FIG. 2 and any aspect of a unit controller as shown as unit controller 60 in FIG. 1. The computer system 300 may comprise a data acquisition system (DAQ) card 322 for communication with one or more sensors. The DAQ card 322 may be a standalone system with a microprocessor, memory, and one or more applications executing in memory. The DAQ card 322, as illustrated, may be a card or a device within the computer system 300. In an embodiment, the DAQ card 322 may be combined with the input-output device 308. The DAQ card 322 may receive one or more analog inputs 324, one or more frequency inputs 326, and one or more Modbus inputs 328. For example, the analog input 324 may include a tub level sensor. For example, the frequency input 326 may include a flow meter. For example, the Modbus input 328 may include a pressure transducer.

ADDITIONAL DISCLOSURE

The following are non-limiting, specific embodiments in accordance with the present disclosure:

A first embodiment, which is a method of training a machine learning process for constructing a wellbore, comprising retrieving, by a machine learning process executing on a computer system, a first job observation comprising an observation description and an observation object; identifying, by a machine learning classifier of the machine learning process, a format of the first job observation, wherein the format comprises the observation description and the observation object; comparing, by the machine learning classifier, the first job observation to a training set of job observations; identifying, by the machine learning classifier, at least one metadata tag from the training set of job observations; applying, by the machine learning process, a combination of metadata tags to the first job observation; generating, by the machine learning process, a classification grade by searching a database for a first job observation with a search criterion comprising the combination of metadata tags; validating, by the machine learning process, the combination of metadata tags by comparing a first classification grade using a first combination of metadata tags to a second classification grade using a second combination of metadata tags to determine an error value; and training the machine learning process to reduce the error value.

A second embodiment, which is the method of the first embodiment, wherein the observation description comprises an text description, picture description, video description, at least one dataset, or combinations thereof, and wherein the at least one dataset is a dataset of measured field data, a dataset of periodic data, or combinations thereof.

A third embodiment, which is the method of the first and second embodiment, wherein the observation object comprises a wellbore treatment, a servicing equipment, a pumping procedure, a wellsite environment, a downhole environment, or combinations thereof.

A fourth embodiment, which is the method of the first embodiments, wherein the at least one metadata tag is selected from a first group of metadata tags, wherein the first group of metadata tags comprises at least two categories of metadata tags.

A fifth embodiment, which is the method of the first embodiment, further comprising generating, by the machine learning classifier, a second job observation by applying the at least one additional metadata tag to the first job observation by comparing a training set of job observations comprising training metadata tags to the second job observation comprising the description and the observation object, wherein the at least one metadata tag corresponding to the first or second job observation are inputs to the machine learning process.

A sixth embodiment, which is the method of any of the fifth embodiments, further comprising grading, by the machine learning process, the second job observation with the combination of metadata tags by comparing a classification grade from the second job observation to a classification grade from the first job observation corresponding to the combination of metadata tags, and wherein the classification grade comprises a ranking value of the search results.

A seventh embodiment, which is the method of any of the first through the sixth embodiments, wherein the ranking value of the search results is determined by a placement of the pending job observation within a set of search results.

An eighth embodiment, which is the method of any of the first through the seventh embodiments, further comprising storing the classification grade and corresponding pending job observation to a database.

A ninth embodiment, which is the method of any of the first through the eighth embodiments, further comprising training the machine learning process with supervised learning in response to the machine learning classifier recognizing the format of the job observation.

A tenth embodiment, which is the method of the first embodiment, further comprising retrieving, by a managing application, a job report and a corresponding job design from the database; and generating, by the managing application utilizing a machine learning process, at least one first job observation in response to a comparison value exceeding a threshold value, and wherein the comparison value is determined by comparing the job report to the job design.

An eleventh embodiment, which is a method of placing a wellbore treatment into a wellbore penetrating a subterranean formation, comprising designing, by a managing application executing on a computer system, a job design, wherein the job design comprises an inventory of materials, a pumping procedure, an inventory of pumping equipment, or combinations thereof; applying, by the managing application utilizing a machine learning process, a set of metadata tags to the job design by comparing the job design to a training set of job designs; comparing, by the machine learning process, the set of metadata tags of the job design to a database of job observations; retrieving, by the machine learning process, a set of relevant job observations from the database in response to a comparison value exceeding a threshold value; alerting, by the managing application, a user device to the relevant job observations from the database; generating, by the machine learning process, a level two job design by modifying the level one job design with one or more relevant job observations in response to a probability value for the level two job design achieving a job objective with the one or more relevant job observations being greater than the probability value for the level one job design achieving a job objective without the one or more relevant job observations; and placing wellbore treatment in the wellbore in accordance with the level two job design.

A twelfth embodiment, which is the method of the eleventh embodiment, further comprising calculating, by the managing application, a bill of materials and an inventory of pumping equipment from the level two job design, and wherein the managing application modifies the level one job design to a level two job design with the bill of materials and the inventory of pumping equipment.

A thirteenth embodiment, which is the method of any of the eleventh through the twelfth embodiment, wherein a machine learning process classifier generates a level one job design by comparing the job design to a training set of job designs; the machine learning process classifier determines a set of metadata tags from the training set of job designs; the machine learning process classifier, applies a set of metadata tags to the level one job design by comparing the job design to training set of job designs; the machine learning process classifier identifies a set of relevant job observations by a comparison value with the database; and wherein the machine learning process retrieves the set of relevant job observations in response to the comparison value exceeding a threshold limit.

A fourteenth embodiment, which is a method of any of the eleventh embodiment, further comprising comparing, by the machine learning process, a first probability value for achieving a job objective by the job design to a second probability value for achieving the job objective by modifying the job design with at least one relevant job observation, wherein the relevant job observation is from the set of job observations retrieved from the database; and replacing, by the machine learning process, the job design with the level one job design in response to the second probability value being greater than the first probability value for achieving the job objective.

A fifteenth embodiment, which is the method of the eleventh through the fourteenth embodiment, wherein the job objective comprises wellbore isolation, a location of top of cement, a kick off plug, a shoe test, or a combination thereof.

A sixteenth embodiment, which is the method of the eleventh embodiment, further comprising transporting a wellbore treatment blend and an inventory of pumping equipment to a wellsite, wherein the wellbore treatment blend is included in the level two job design; beginning a wellbore treatment procedure by the managing application; retrieving, by the managing application, one or more datasets of periodic pumping data indicative of the wellbore treatment procedure; mixing a wellbore treatment, by the pumping equipment, per the wellbore treatment procedure; pumping the wellbore treatment blend per the wellbore treatment procedure; alerting, by the managing application, if at least one dataset of periodic pumping data indicative of the wellbore treatment procedure indicates a change to the wellbore treatment procedure; generating, by the managing application, a job observation; comparing, by a machine learning process, a combination of metadata tags of the job observation to the metadata tags of a plurality of historical job observations in a database; calculating, the machine learning process, a probability score for achieving the job objective based on at least one of the historical job observations; recommending, by the machine learning process, modifying the job design of the wellbore treatment to increase the probability score above a threshold value; and continuing the wellbore treatment procedure, by the managing application, in response to the probability score being above the threshold value for achieving the job objective.

A seventeenth embodiment, which is the method of any of the eleventh through sixteenth embodiments, further comprising transporting a downhole tool to a wellsite, wherein the downhole tool is included in the level two job design; beginning a wellbore treatment procedure by the managing application; coupling the downhole tool with a casing via the wellbore treatment procedure; retrieving, by the managing application, one or more datasets of periodic pumping data indicative of the wellbore treatment procedure; alerting, by the managing application, if at least one dataset of periodic pumping data indicative of the wellbore treatment procedure indicates a change to the wellbore treatment procedure; generating, by the managing application, a job observation; comparing, by a machine learning process, a combination of metadata tags of the job observation to the metadata tags of a plurality of historical job observations in a database; calculating, the machine learning process, a probability score for achieving the job objective based on a historical job observation; recommending, by the machine learning process, modifying the job design of the wellbore treatment to increase the probability score above a threshold value; and continuing the wellbore treatment procedure, by the managing application, in response to the probability score being above the threshold value for achieving the job objective.

An eighteenth embodiment, which is a method of placing a wellbore treatment within a wellbore utilizing a job observation of the well servicing operation, comprising retrieving, by a managing application executing on a User Equipment (UE), a job design comprising a pumping procedure, a bill of materials, an inventory of assigned pumping units, an inventory of downhole tools, an inventory of various chemicals, or combinations thereof, wherein the pumping procedure comprises a series of sequential stages to achieve a job objective; transporting the job design to a wellsite; beginning the pumping procedure by the managing application executing on the UE communicatively connected to the pumping units; retrieving, by the managing application, one or more datasets of periodic pumping data indicative of the pumping procedure; receiving, by the managing application, at least one dataset indicative of a change to the pumping procedure; generating, by the managing application, a job observation; comparing, by a machine learning process, a combination of metadata tags of the job observation to the combinations of metadata tags of a plurality of historical job observations in a database; retrieving, by a machine learning process, a set of historical job observations from the database with the combination of metadata tags that exceed a comparison threshold value; determining, by a machine learning process, a portion of historical pumping procedure that corresponds to the job observation by comparing a set of historical job designs and historical job reports that correspond to the historical job observations from the database; determining, by the managing application, a probability of achieving the job objective with the portion of the historical pumping procedure based on machine learning process by accessing the job reports within the database; modifying, by the managing application, the portion of the pumping procedure that corresponds to the job observation with the portion of the historical pumping procedure that corresponds with the historical job observation; recommending, by the machine learning process, the portion of the pumping procedure that corresponds with the job observation be replaced with the portion of the historical pumping procedure to increase a probability score above a threshold value; and continuing the pumping procedure, by the managing application, in response to the probability score being above the threshold value for achieving the job objective.

A nineteenth embodiment, which is the method of the eighteenth embodiment, further comprising determining, by the machine learning process, a set of metadata tags from a training set job observations.

A twentieth embodiment, which is the method of the eighteenth embodiment, wherein the database is on a computer system, a local network, a local data source, or a remote data source; and wherein the remote data source is a server, a computer system, a virtual computer system, a virtual network function, or data storage device.

A twenty-first embodiment, which is a method of the eighteenth embodiment, wherein the job observation comprises an operational dataset, a portion of the pumping procedure, a current step of the pumping procedure, a set of identification data, or combinations thereof.

A twenty-second embodiment, which is the method of any of the eighteenth through the twenty-first embodiment, further comprising transporting a modified job design to a wellsite, wherein the modified job design includes the job design and additional materials based on at least one historical job observations; beginning a wellbore treatment procedure by the managing application; coupling a downhole tool with a casing string via the wellbore treatment procedure; retrieving, by the managing application, one or more datasets of periodic pumping data indicative of the wellbore treatment procedure; receiving, by the managing application, at least one dataset indicative of a change to the pumping procedure; generating, by the managing application, a job observation; alerting, by the managing application, if the job observation does not correspond to the historical job observations; calculating, by a machine learning process, the probability score for achieving the job objective by modifying a portion of the pumping procedure based on the at least one historical job observation; recommending, by the machine learning process, one or more portions of the modified pumping procedures to replace one or more portions of the pumping procedure to increase the probability score above a threshold value; and continuing the modified pumping procedure, by the managing application, in response to the probability score being above the threshold value for achieving the job objective.

A twenty-third embodiment, which is a method of the eleventh embodiment, wherein the machine learning process comprises a model trained by the method of claim 1.

A twenty-fourth embodiment, which is a method of the eighteenth embodiment, wherein the machine learning process comprises a model trained by the method of claim 1.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A computer-implemented method of training a machine learning model for constructing a wellbore, comprising:

retrieving a first job observation comprising an observation description and an observation object;

identifying a format of the first job observation, wherein the format comprises the observation description and the observation object;

comparing the first job observation to a training set of job observations;

identifying metadata tags from the training set of job observations;

applying the metadata tags to the first job observation to form a first group of metadata tags;

generating a classification grade by searching a database for the first job observation with a search criterion comprising the metadata tags;

validating the metadata tags by comparing a first classification grade using a first combination of the metadata tags used to form a second group of metadata tags to a second classification grade using a second combination of the metadata tags used to form the second group of metadata tags, to determine an error value; and training a machine learning model to reduce the error value by modifying the first combination or the second combination.

2. The computer-implemented method of claim 1, wherein:

the observation description comprises a text description, picture description, video description, at least one dataset, or combinations thereof, and wherein the at least one dataset is a dataset of measured field data, a dataset of periodic data, or combinations thereof.

3. The computer-implemented method of claim 1, wherein:

the observation object comprises a wellbore treatment, a servicing equipment, a pumping procedure, a wellsite environment, or a downhole environment.

4. The computer-implemented method of claim 1, wherein:

the first group of metadata tags comprises at least two categories of metadata tags.

5. The computer-implemented method of claim 1, further comprising:

generating a second job observation by applying at least one additional metadata tag to the first job observation by comparing a training set of job observations comprising training metadata tags to the second job observation comprising the observation description and the observation object.

6. The computer-implemented method of claim 5, wherein:

the first classification grade and the second classification grade comprise ranking values of search results.

7. The computer-implemented method of claim 6, wherein the ranking value of the search results is determined by a placement of a pending job observation.

8. The computer-implemented method of claim 1, further comprising:

retrieving a job report and a corresponding job design from the database; and generating the first job observation in response to a comparison value exceeding a threshold value, wherein the comparison value is determined by comparing the job report to the job design.

9. A computer-implemented method of placing a wellbore treatment into a wellbore penetrating a subterranean formation, comprising:

designing a job design, wherein the job design comprises an inventory of materials, a pumping procedure, an inventory of pumping equipment, or combinations thereof;

applying a set of metadata tags from a training set of job observations to the job design by comparing the job design to a training set of job designs;

comparing the set of metadata tags of the job design to a database of job observations;

retrieving a set of relevant job observations from the database in response to a comparison value exceeding a threshold value;

alerting a user device to the relevant job observations from the database;

generating a level two job design by modifying a level one job design with one or more relevant job observations in response to a probability value for the level two job design achieving a job objective with the one or more relevant job observations being greater than the probability value for the level one job design achieving a job objective without the one or more relevant job observations; and placing wellbore treatment in the wellbore, using cementing equipment, in accordance with the level two job design, wherein the metadata tags are validated by comparing a first classification grade using a first combination of the metadata tags used to form a group of metadata tags to a second classification grade using a second combination of the metadata tags used to form the group of metadata tags, to determine an error value, and wherein a machine learning model is trained such that the error value is reduced, by modifying the first combination or the second combination.

10. The computer-implemented method of claim 9, further comprising:

calculating a bill of materials and an inventory of pumping equipment from the level two job design, and wherein the level one job design is modified to the level two job design with the bill of materials and the inventory of pumping equipment.

11. The computer-implemented method of claim 9, further comprising:

generating the level one job design by comparing the job design to a training set of job designs;

determining a set of metadata tags from the training set of job designs;

applying a set of metadata tags to the level one job design by comparing the job design to the training set of job designs;

identifying a set of relevant job observations by a comparison value with the database; and receiving the set of relevant job observations, in response to the comparison value exceeding a threshold limit.

12. The computer-implemented method of claim 11, further comprising:

comparing a first probability value for achieving a job objective by the job design to a second probability value for achieving the job objective by modifying the job design with at least one relevant job observation, wherein the relevant job observation is from the set of job observations retrieved from the database; and replacing the job design with the level one job design in response to the second probability value being greater than the first probability value.

13. The computer-implemented method of claim 9, wherein:

the job objective comprises wellbore isolation, a location of top of cement, a kick off plug, a shoe test, or a combination thereof.

14. The computer-implemented method of claim 9, further comprising:

retrieving one or more datasets of periodic pumping data indicative of a wellbore treatment procedure;

mixing a wellbore treatment, using pumping equipment, according to the wellbore treatment procedure;

pumping a wellbore treatment blend, using the pumping equipment according to the wellbore treatment procedure;

generating an alert in response to at least one dataset of periodic pumping data indicative of the wellbore treatment procedure indicating a change to the wellbore treatment procedure;

generating a job observation;

comparing a combination of metadata tags of the job observation to the metadata tags of a plurality of historical job observations in a database;

calculating a probability score for achieving the job objective based on at least one of the historical job observations;

recommending modifying the job design of the wellbore treatment to increase the probability score above a threshold value; and continuing the wellbore treatment procedure in response to the probability score being above the threshold value for achieving the job objective.

15. The computer-implemented method of claim 9, further comprising:

retrieving one or more datasets of periodic pumping data indicative of a wellbore treatment procedure;

generating an alert in response to at least one dataset of the periodic pumping data indicating a change to the wellbore treatment procedure;

generating a job observation;

comparing a combination of metadata tags of the job observation to the metadata tags of a plurality of historical job observations in a database;

calculating a probability score for achieving the job objective based on a historical job observation;

recommending modifying the job design of the wellbore treatment to increase the probability score above a threshold value; and continuing the wellbore treatment procedure in response to the probability score being above the threshold value for achieving the job objective.

16. A computer-implemented method of placing a wellbore treatment within a wellbore utilizing a job observation of a well servicing operation, comprising:

retrieving a job design comprising a pumping procedure, a bill of materials, an inventory of assigned pumping units, an inventory of downhole tools, an inventory of chemicals, or combinations thereof, wherein the pumping procedure comprises a series of sequential stages to achieve a job objective;

retrieving one or more datasets of periodic pumping data indicative of the pumping procedure;

receiving at least one dataset indicative of a change to the pumping procedure;

generating a job observation;

comparing a combination of metadata tags, referring to the at least one dataset of the job observation to the combinations of metadata tags of a plurality of historical job observations in a database;

retrieving a set of historical job observations from the database with the combination of metadata tags that exceed a comparison threshold value;

determining a portion of historical pumping procedure that corresponds to the job observation by comparing a set of historical job designs and historical job reports that correspond to the historical job observations from the database;

determining a probability of achieving the job objective with the portion of the historical pumping procedure by accessing the job reports within the database;

modifying the portion of the pumping procedure that corresponds to the job observation with the portion of the historical pumping procedure that corresponds with the historical job observation;

recommending the portion of the pumping procedure that corresponds with the job observation be replaced with the portion of the historical pumping procedure to increase a probability score above a threshold value; and continuing the pumping procedure in response to the probability score being above the threshold value for achieving the job objective, wherein the metadata tags are validated by comparing a first classification grade using a first combination of the metadata tags used to form a group of metadata tags to a second classification grade using a second combination of the metadata tags used to form the group of metadata tags, to determine an error value, and wherein a machine learning model is trained such that the error value is reduced, by modifying the first combination or the second combination.

17. The method of claim 16, further comprising:

determining a set of metadata tags from a training set of job observations.

18. The computer-implemented method of claim 16, wherein the database is on a computer system, a local network, a local data source, or a remote data source; and wherein the remote data source is a server, a computer system, a virtual computer system, a virtual network function, or data storage device.

19. The computer-implemented method of claim 16, wherein the job observation comprises an operational dataset, a portion of the pumping procedure, a current step of the pumping procedure, a set of identification data, or combinations thereof.

20. The computer-implemented method of claim 16, further comprising:

retrieving one or more datasets of periodic pumping data indicative of a wellbore treatment procedure;

receiving at least one dataset indicative of a change to a pumping procedure;

generating a job observation;

generating an alert in response to the job observation not corresponding to at least one historical job observation;

calculating the probability score for achieving the job objective by modifying a portion of the pumping procedure based on the at least one historical job observation;

recommending one or more portions of the modified pumping procedure to replace one or more portions of the pumping procedure to increase the probability score above a threshold value; and continuing the modified pumping procedure in response to the probability score being above the threshold value for achieving the job objective.

* * * * *